US008256630B2

(12) United States Patent
Zhu et al.

(10) Patent No.: US 8,256,630 B2
(45) Date of Patent: Sep. 4, 2012

(54) FOLDABLE AND PORTABLE STORAGE SHELF

(76) Inventors: Shou Qiang Zhu, Wanchai (HK); Edward Zheng, Wanchai (HK)

( * ) Notice: Subject to any disclaimer, the term of this patent is extended or adjusted under 35 U.S.C. 154(b) by 0 days.

(21) Appl. No.: 12/927,636

(22) Filed: Nov. 19, 2010

(65) Prior Publication Data

US 2011/0068072 A1 Mar. 24, 2011

Related U.S. Application Data

(63) Continuation of application No. 12/653,307, filed on Dec. 11, 2009.

(60) Provisional application No. 61/269,610, filed on Jun. 25, 2009.

(51) Int. Cl.
*A47F 5/08* (2006.01)

(52) U.S. Cl. ..... 211/149; 211/195

(58) Field of Classification Search ..... 211/85, 211/149, 195; 280/651, 79.3, 42; 108/163, 108/115, 170

See application file for complete search history.

(56) References Cited

U.S. PATENT DOCUMENTS

| | | | | |
|---|---|---|---|---|
| 2,938,632 | A * | 5/1960 | Mondineu | 108/106 |
| 3,212,605 | A * | 10/1965 | Dickerson | 182/119 |
| 4,740,010 | A * | 4/1988 | Moskovitz | 280/641 |
| 6,851,564 | B2 * | 2/2005 | Ng | 211/149 |
| 7,389,887 | B2 * | 6/2008 | Liang | 211/149 |

* cited by examiner

*Primary Examiner* — Korie H. Chan

(57) ABSTRACT

A frame structure includes two side frames and a foldable frame coupled with the side frames to fold between an unfolded position and a folded position. The foldable frame includes a transmission link supported between the side frames, a sliding joint slidably coupling with the transmission link, and two folding arms coupling the transmission link to the side frames respectively. Each of the folding arms has an upper end pivotally coupling with the sliding joint and a lower end pivotally coupling with the respective side frame. At the unfolded position, the sliding joint is upwardly slid to an upper end of the transmission link to move the side frames away from each other. At the folded position, the sliding joint is downwardly slid away from the upper end of said transmission link to move the side frames towards each other for folding the side frames side-by-side.

16 Claims, 24 Drawing Sheets

FOLDABLE AND PORTABLE STORAGE SHELF

CROSS REFERENCE TO RELATED APPLICATION

This is a Continuation application that claims the benefit of priority under 35 U.S.C. §119 to a non-provisional application having an application No. 12/653,307 and a filing date of Dec. 11, 2009, which is a non-provisional application of a provisional application having an application No. 61/269,610 and a filing date of Jun. 25, 2009.

BACKGROUND OF THE PRESENT INVENTION

1. Field of Invention

The present invention relates to a foldable furniture, and more particularly to a foldable and portable storage shelf, which is facilitated to be folded into a compact unit for storage and carriage.

2. Description of Related Arts

A conventional storage shelf generally comprises a rack frame and a panel frame comprising a plurality of panels spacedly and horizontally supported by the rack frame. The rack frame generally comprises two end frames spacedly supported to define a panel distance therebetween, wherein the panels are transversely supported between the two end frames. It is worth mentioning that when the panels are transversely supported between the end frames, the panels and the end frames are mutually supported each other to retain the structure of the storage shelf. In addition, the most distinctive feature of the storage shelf is that the storage shelf should have three opened sides for being accessed. In other words, the front, left, and right sides of the storage shelf must be opened for the user to access the storage cavity of the storage shelf.

Accordingly, the conventional storage shelf has the following drawbacks. The storage shelf must have a rigid structure in order to support the object such that the storage shelf will be bulky and heavy. Therefore, it is a hassle for the manufacturers and the users store and carry the storage shelf. When the storage shelf is used in the closet, the user must build the storage shelf inside the closet because it cannot be fitted into the door of the closet due to the size of the storage shelf.

In order to solve the above mention problem, the storage shelf may incorporate with a foldable structure. However, such foldable storage shelf fails to well support the objects thereat because of the moving parts of the foldable structure. In order to rigidly support the objects, the foldable structure must provide a rigid cross-support which may increase the overall weight of the storage shelf. Accordingly, the cross-support is provided at each of the end frames to form a rigid structure thereof to support the panel frame. However, the cross-support may block the opened side of the end frame such that the storage shelf will only have the front opened side for being accessed. In addition, more connecting joints must be used for connecting to the rack frame in order to enhance the supportability of the storage shelf and the foldable ability of the rack frame thereof However, the storage shelf with the foldable structure cannot be entirely folded into a compact unit which is bulky and difficult to carriage. Accordingly, the storage shelf generally has a rectangular shape that the width of the storage shelf, i.e. the width of the end frame, is smaller than the length of the storage shelf, i.e. the length of the panel. Therefore, even though the storage shelf can be folded by minimizing the width of the storage shelf, the storage shelf cannot be formed into a compact unit. Another drawback of the foldable storage shelf is how to lock up the rack frame in an unfolded position. If the rack frame cannot be secured at its unfolded position, the storage shelf cannot provide a rigid support for the objects.

Another storage shelf may incorporate with a detachable structure that the panels and the rack frame can be detached from each other to minimize the storage space. However, it is a hassle for the user to assemble the storage shelf When the storage shelf is needed to move from one place to another place, the user must disassemble the storage shelf from one place and re-assemble the storage shelf at another place. In addition, if one of the detachable parts is missing, the storage shelf cannot be assembled.

SUMMARY OF THE PRESENT INVENTION

A main object of the present invention is to provide a foldable and portable storage shelf, which provides a strong foldable frame structure that can well support the object.

Another object of the present invention is to provide a foldable and portable storage shelf which can be quickly and easily folded into a compact unit for carriage and storage and unfolded for use.

Another object of the present invention is to provide a foldable and portable storage shelf, which has a simple construction that every individual is able to fold and unfold the foldable storage shelf in one single motion.

Another object of the present invention is to provide a foldable and portable storage shelf, wherein different reinforcing mechanisms are incorporated with the storage shelf to secure the storage shelf at the unfolded position.

Another object of the present invention is to provide a foldable and portable storage shelf, wherein the weight of the object applied on the storage shelf will further ensure the construction of the storage shelf for rigidly support the object thereon and ensure the storage shelf at the unfolded position.

Another object of the present invention is to provide a foldable and portable storage shelf, wherein no detachable part is required for detaching from the side frame so as to prevent any missing part of the storage shelf after it is disassembled.

Another object of the present invention is to provide a foldable and portable storage shelf, wherein no expensive or complicate mechanical structure is required to employ in the present invention in order to achieve the above mentioned objects. Therefore, the present invention successfully provides an economic and efficient solution for providing a rigid foldable structure of the storage shelf and a reinforced support configuration to support the desired objects.

Accordingly, in order to accomplish the above objects, the present invention provides a foldable and portable storage shelf, comprising:

two spaced apart side frames;

a panel assembly which comprises a plurality of foldable shelf panels spacedly supported between the two side frames; and a foldable frame pivotally coupled between the two side frames to fold between an unfolded position and a folded position, wherein at the unfolded position, the side frames are pivotally moved apart from each other to retain each of the foldable shelf panels in a horizontal manner, and at the folded position, the side frames are pivotally moved towards each other such that each of the foldable shelf panels is folded in an overlapped manner.

These and other objectives, features, and advantages of the present invention will become apparent from the following detailed description, the accompanying drawings, and the appended claims.

DETAILED DESCRIPTION OF THE PREFERRED EMBODIMENT

Figure 1:
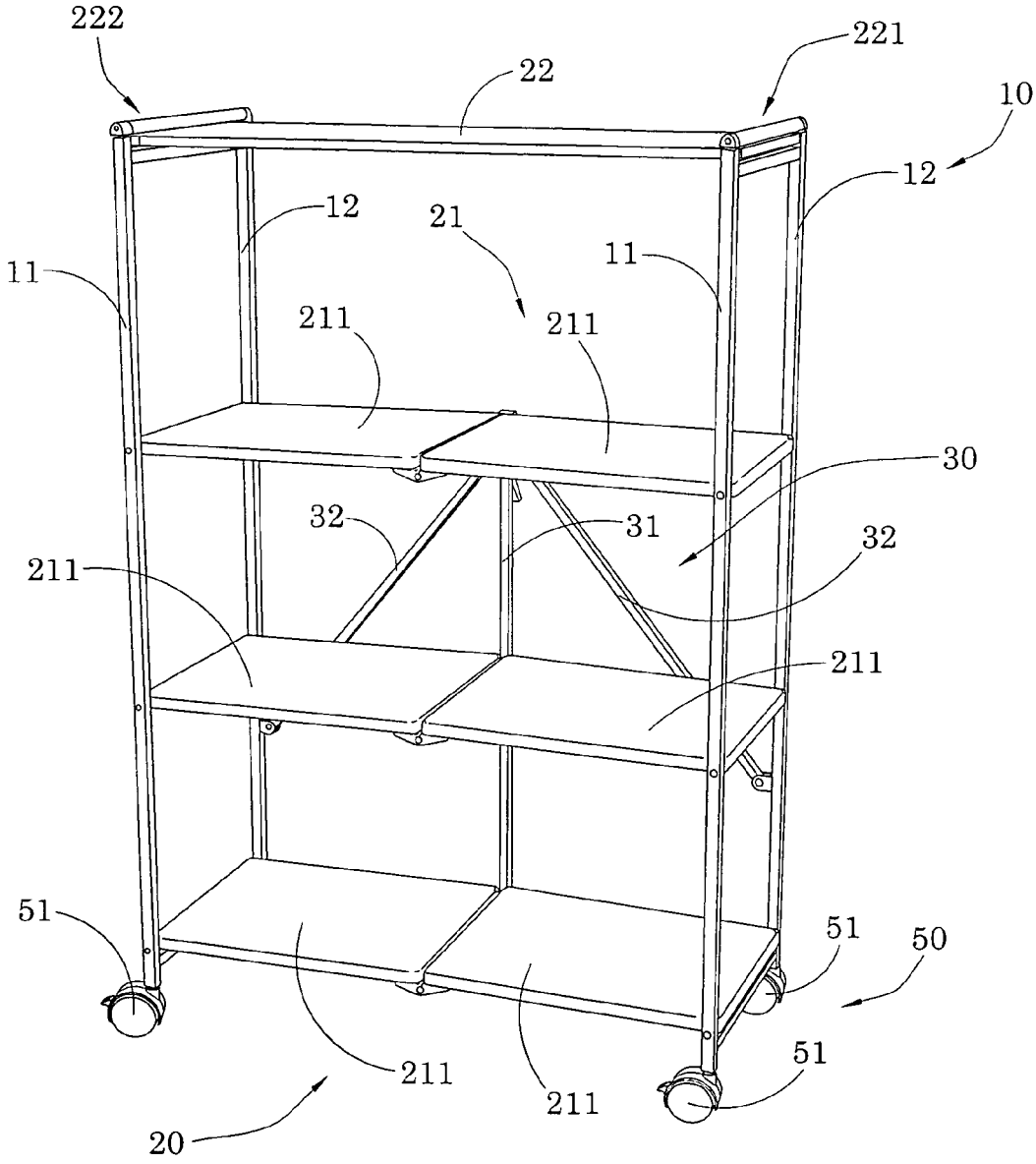
FIG. 1 is a perspective view of a foldable and portable storage shelf according to a preferred embodiment of the present invention, illustrating the foldable and portable storage shelf being folded at an unfolded position.

Referring to FIG. 1 of the drawings, a foldable and portable storage shelf according to a preferred embodiment of the present invention is illustrated, wherein the foldable and portable storage shelf comprises two spaced apart side frames 10, a panel assembly 20, and a foldable frame 30.

The foldable frame 30 is operatively coupled with the side frames 10 to fold the panel assembly 20 between an unfolded position and a folded position. At the unfolded position, the panel assembly 20 is rigidly supported between the side frames 10 to form a shelf structure for supporting an object. In addition, at the unfolded position, the foldable portable storage shelf provides three opened sides, i.e. the front side, left side, and right side, for being accessed. At the folded position, each of the side frames 10 is folded with the panel assembly 20 to minimize an overall size of the shelf structure of the foldable and portable storage shelf.

Accordingly, the two side frames 10 are identical. Each of the side frames 10 comprises two tubular supporting members 11, 12, i.e. front supporting member 11 and rear supporting member 12, spacedly supporting with each other in a vertical manner, such that the four supporting members 11, 12 form four supporting posts at four corners of the storage shelf respectively. In addition, the front and rear supporting members 11, 12 form an opened area therebetween.

The panel assembly 20 comprises a plurality of foldable shelf panels 21 spacedly and pivotally supported between the two side frames 10, wherein each of the foldable shelf panels 21 comprises two side panels 211 pivotally coupled with each other edge-to-edge to define a pivot point 210 between the two inner edges of the side panels 211. The two side panels 211 are identical that the outer edges of the side panels 211 are pivotally coupled with the side frames 10 respectively such that when the two inner edges of the side panels 211 are upwardly folded, the two side panels 211 are overlapped with each other at the folded position.

Accordingly, a width of each of the foldable shelf panels 21 correspondingly matches with a distance between the two supporting members 11 of each of the side frames 10 such that the foldable shelf panels 21 are securely supported by the supporting members 11 of the side frames 10. As shown in FIG. 1, there are three foldable shelf panels 21 being supported between the two side frames 10.

Figure 2:
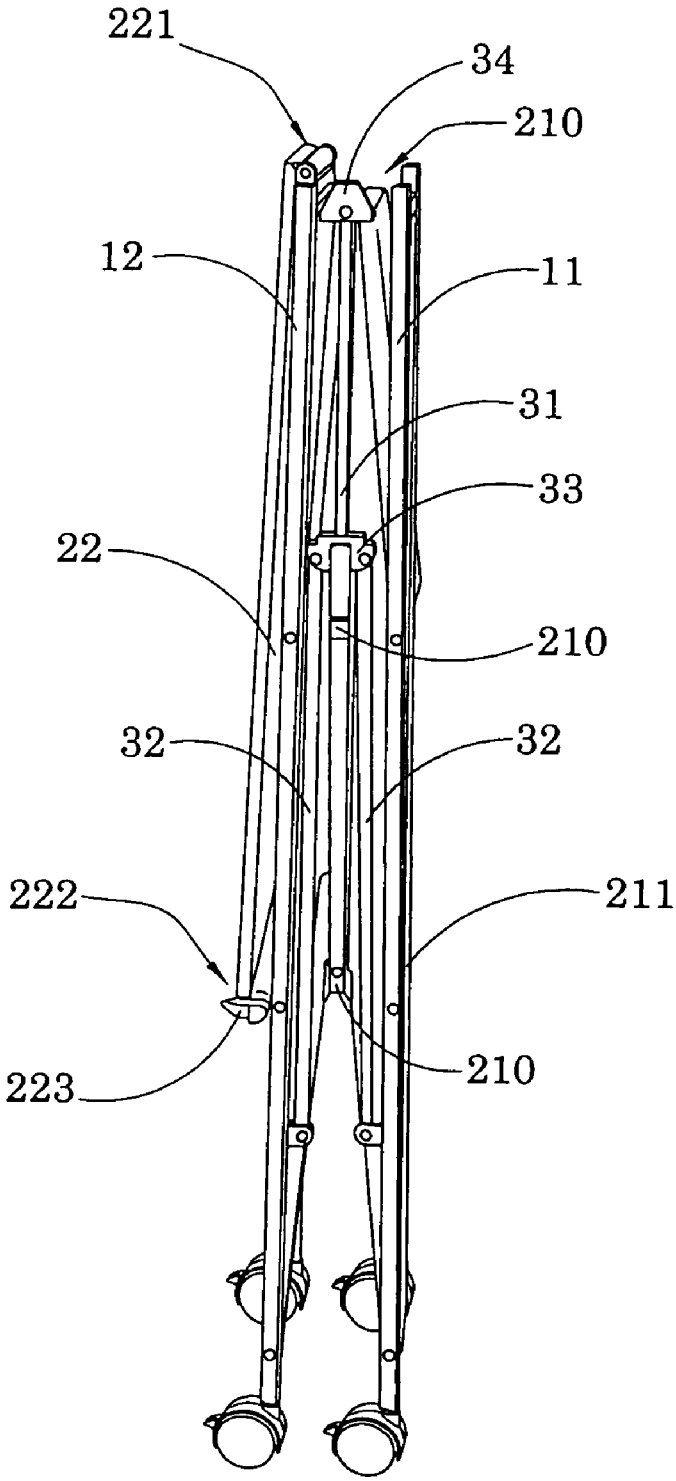
FIG. 2 is a side view of the foldable and portable storage shelf according to the above preferred embodiment of the present invention, illustrating the foldable and portable storage shelf being folded at a folded position.
Figure 3:
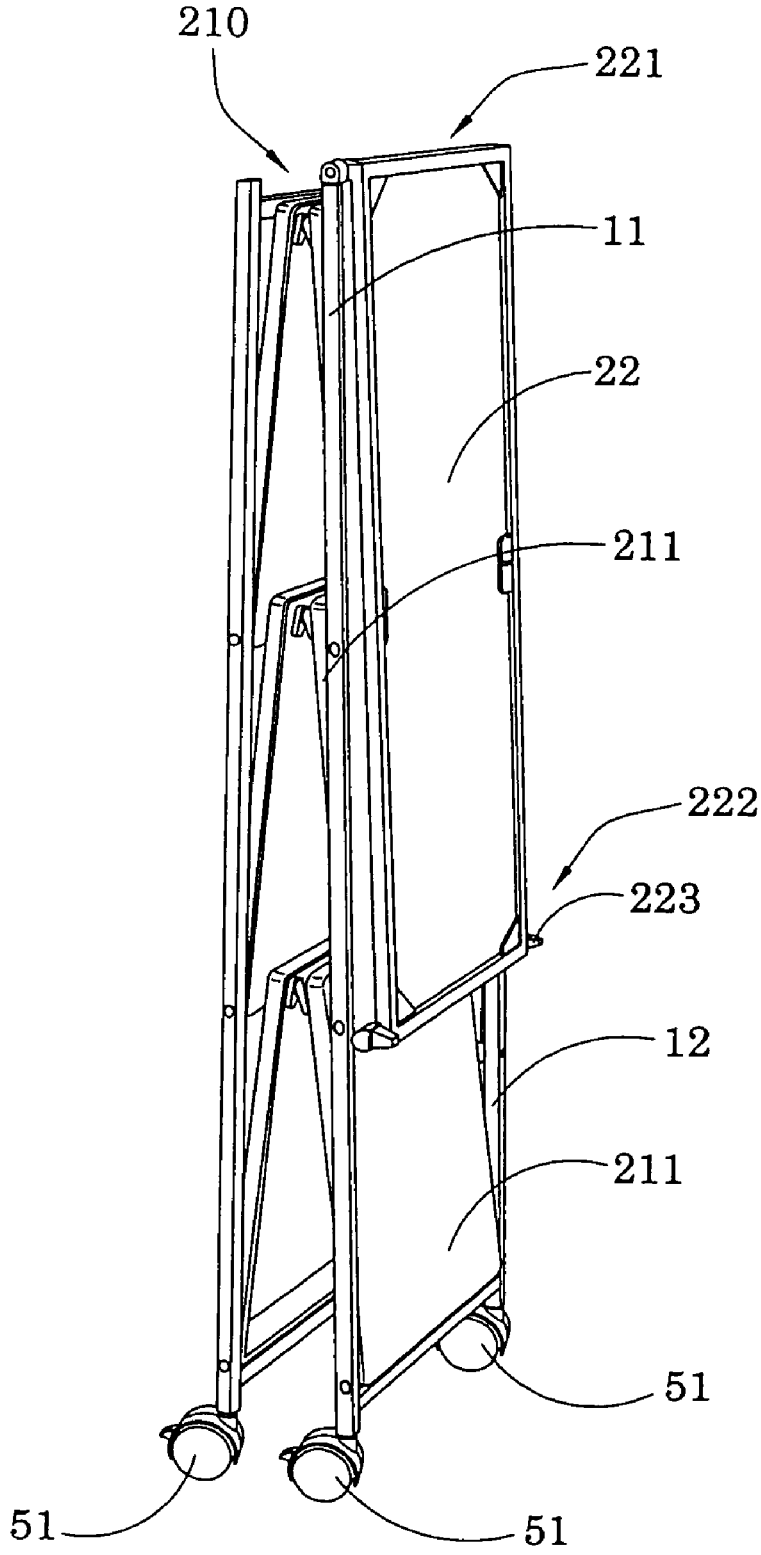
FIG. 3 is a perspective view of the foldable and portable storage shelf at the folded position according to the above preferred embodiment of the present invention.

The foldable frame 30 is pivotally coupled between the two side frames 10 to fold between the unfolded position and the folded position. At the unfolded position, as shown in FIG. 1, the side frames 10 are pivotally moved apart from each other to retain each of the foldable shelf panels 21 in a horizontal manner. In other words, at the unfolded position, the foldable shelf panels 21 are spacedly and transversely extended between the two side frames 10, wherein the side panels 211 of each of the foldable shelf panels 21 are aligned edge-to-edge to form a planar configuration, such that the object can be placed at the foldable shelf panels 21. At the folded position, as shown in FIGS. 2 and 3, the side frames 10 are pivotally moved towards each other such that each of the foldable shelf panels 21 is folded in an overlapped manner. In other words, at the folded position, the side frames 10 are moved towards each other to minimize a distance between the side frames 10 while the foldable shelf panels 21 are folded parallel to the side frames 10.

According to the preferred embodiment, the foldable frame 30 comprises a transmission link 31 pivotally coupling with the pivot points 210 of the foldable shelf panels 21 and two folding arms 32 movably coupling the transmission link 31 to the side frames 21 respectively to retain the distance between the side frames 10 at the unfolded position.

Figure 4:
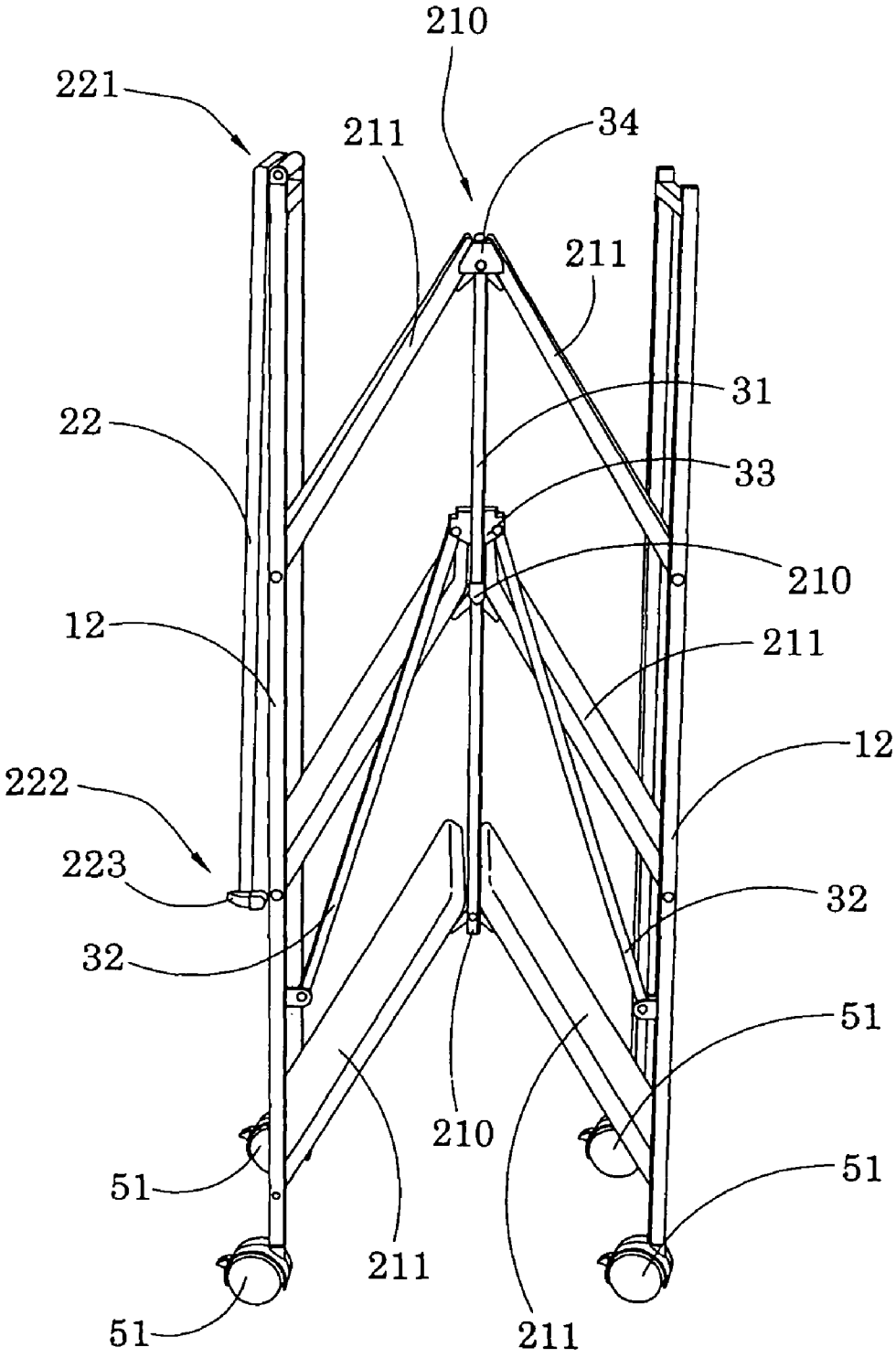
FIG. 4 is a perspective view of the foldable and portable storage shelf according to the above preferred embodiment of the present invention, illustrating the folding operation of the foldable and portable storage shelf.
Figure 5:
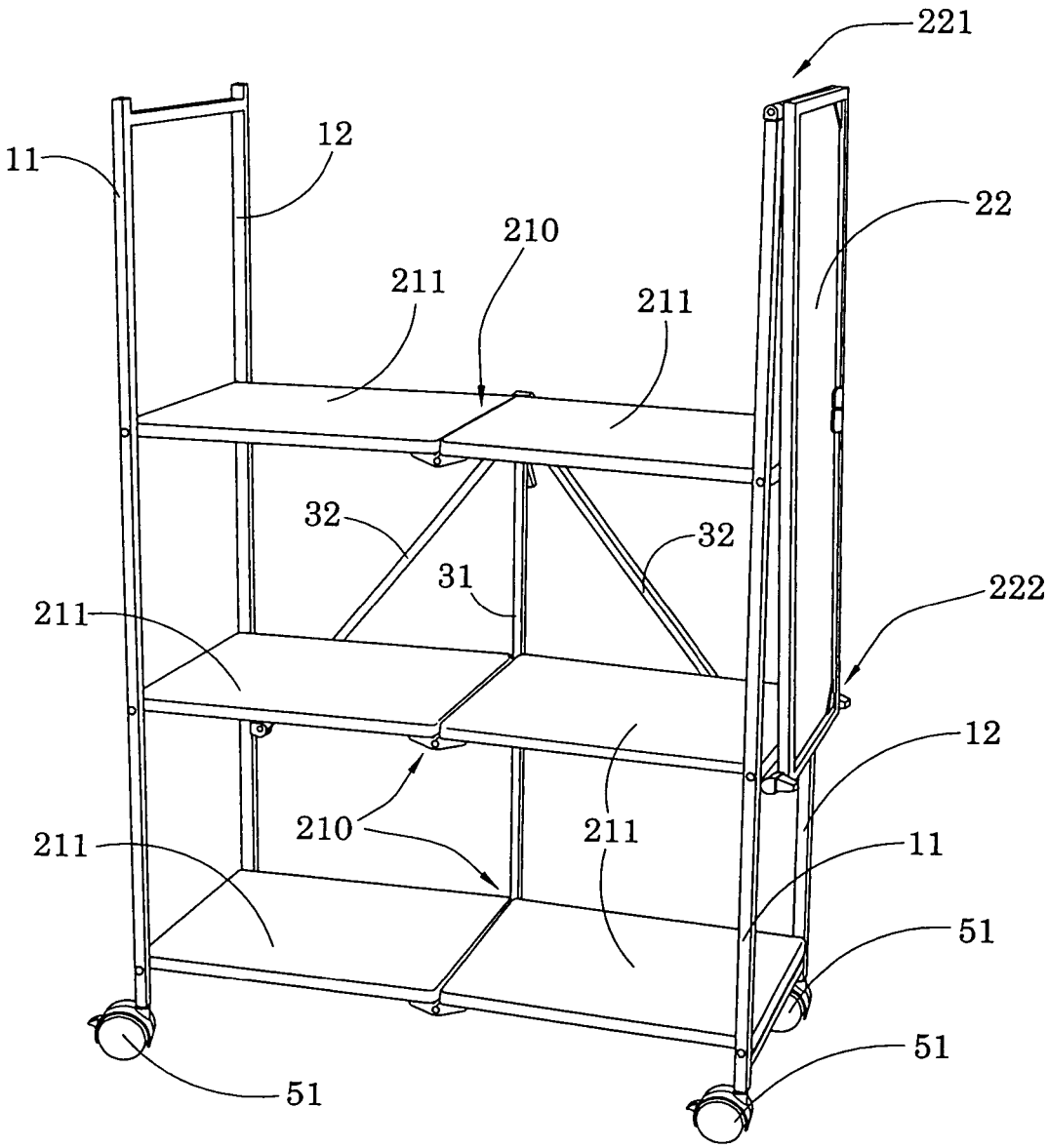
FIG. 5 is a perspective view of the foldable and portable storage shelf according to the above preferred embodiment of the present invention, illustrating the top retention panel unlocking with the side frame.

As shown in FIG. 4, the transmission link 31 is an elongated member vertically supported between the two side frames 10, wherein the transmission link 31 has an upper end 311 coupling with the uppermost foldable shelf panel 21 at the pivot point 210 thereof and a lower end 312 coupling with the lowermost foldable shelf panel 21 at the pivot point 210 thereof in such a manner that when the transmission link 31 is moved upwardly at a vertical direction, the foldable shelf panels 21 are pivotally and concurrently folded to overlap the two corresponding side panels 211 of each of the foldable shelf panels 21 with each other. Likewise, when the transmission link 31 is moved downwardly at a vertical direction, the foldable shelf panels 21 are pivotally and concurrently folded at a position that the corresponding side panels 211 of each of the foldable shelf panels 21 are folded edge-to-edge in a single planar configuration.

The foldable frame 30 further comprises a sliding joint 33 slidably coupling with the transmission link 31 such that the sliding joint 33 is adapted to slide along the transmission link 31 between the upper end and the lower end. Accordingly, when the foldable frame 30 is folded to its folded position, the sliding joint 33 is slid along the transmission link 31 away from the upper end thereof. When the foldable frame 30 is folded to its unfolded position, the sliding joint 33 is slid along the transmission link 31 at the upper end thereof.

Each of the folding arms 32 has an upper end pivotally coupling with the sliding joint 33 and a lower end pivotally coupling with the rear supporting member 12 of the corresponding side frame 10. As shown in FIG. 4, when the two side frames 10 are folded towards each other, i.e. the folded position, the transmission link 31 is vertically and upwardly moved to fold up the foldable shelf panels 21. At the same time, the sliding joint 33 is slid away from the upper end of the transmission link 31 to ensure the two side frames 10 being folded side-by-side. When the foldable frame 30 is folded at the unfolded position, the transmission link 31 is vertically and downwardly moved to unfold the foldable shelf panels 21. At the same time, the sliding joint 33 is slid at the upper end of the transmission link 31 to fully extend the distance between the side frames 10.

It is worth to mention that each of the folding arms 32 is extended in an inclined manner to form a triangular configuration between the side frames 10 and the transmission link 31 so as to provide a rigid support of the panel assembly 20. In addition, when the object is placed on the folding shelf panel 21, the downward force of the object, i.e. the weight of the object, is substantially exerted on the folding shelf panel 21 to the transmission link 31, so as to ensure the foldable frame 30 being folded at the unfolded position. In other words, the downward force of the object will prevent the foldable frame 30 from being folded back to its folded position accidentally.

Figure 7:
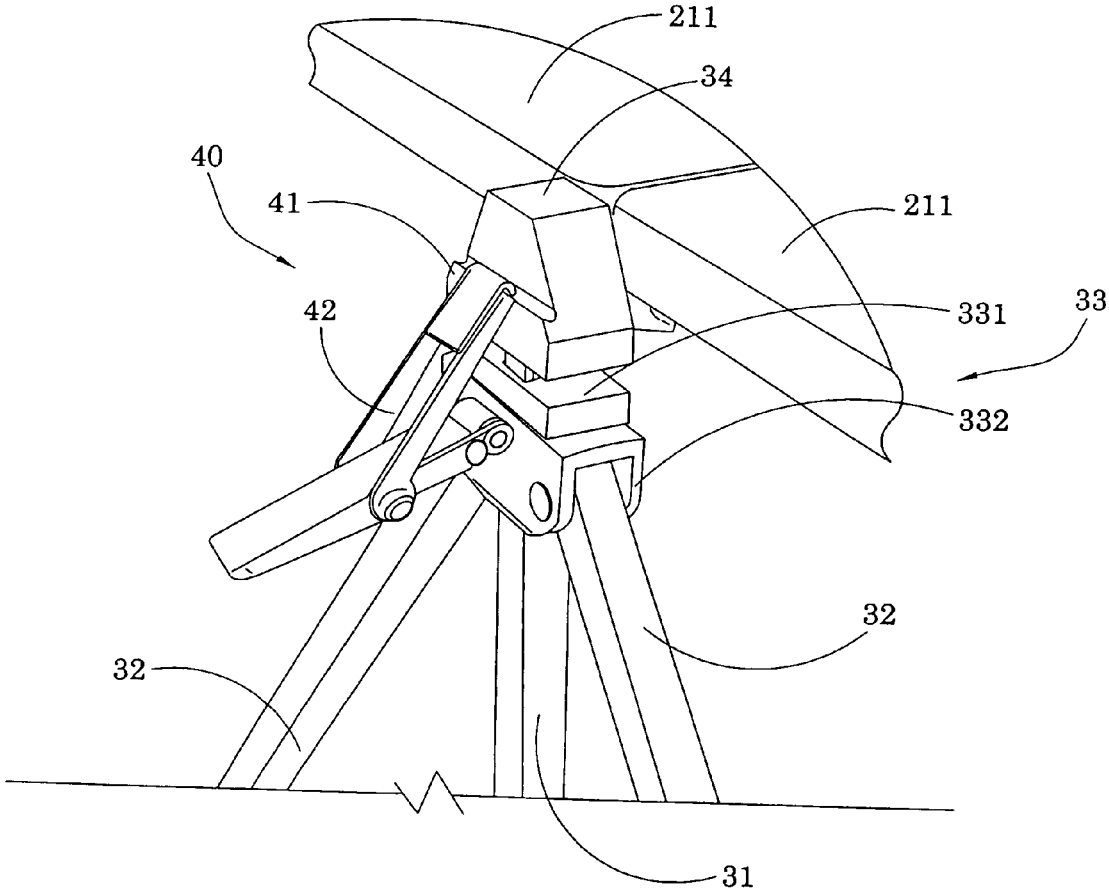
FIG. 7 is a perspective view of a shelf locker of the foldable and portable storage shelf according to the above preferred embodiment of the present invention.
Figure 8:
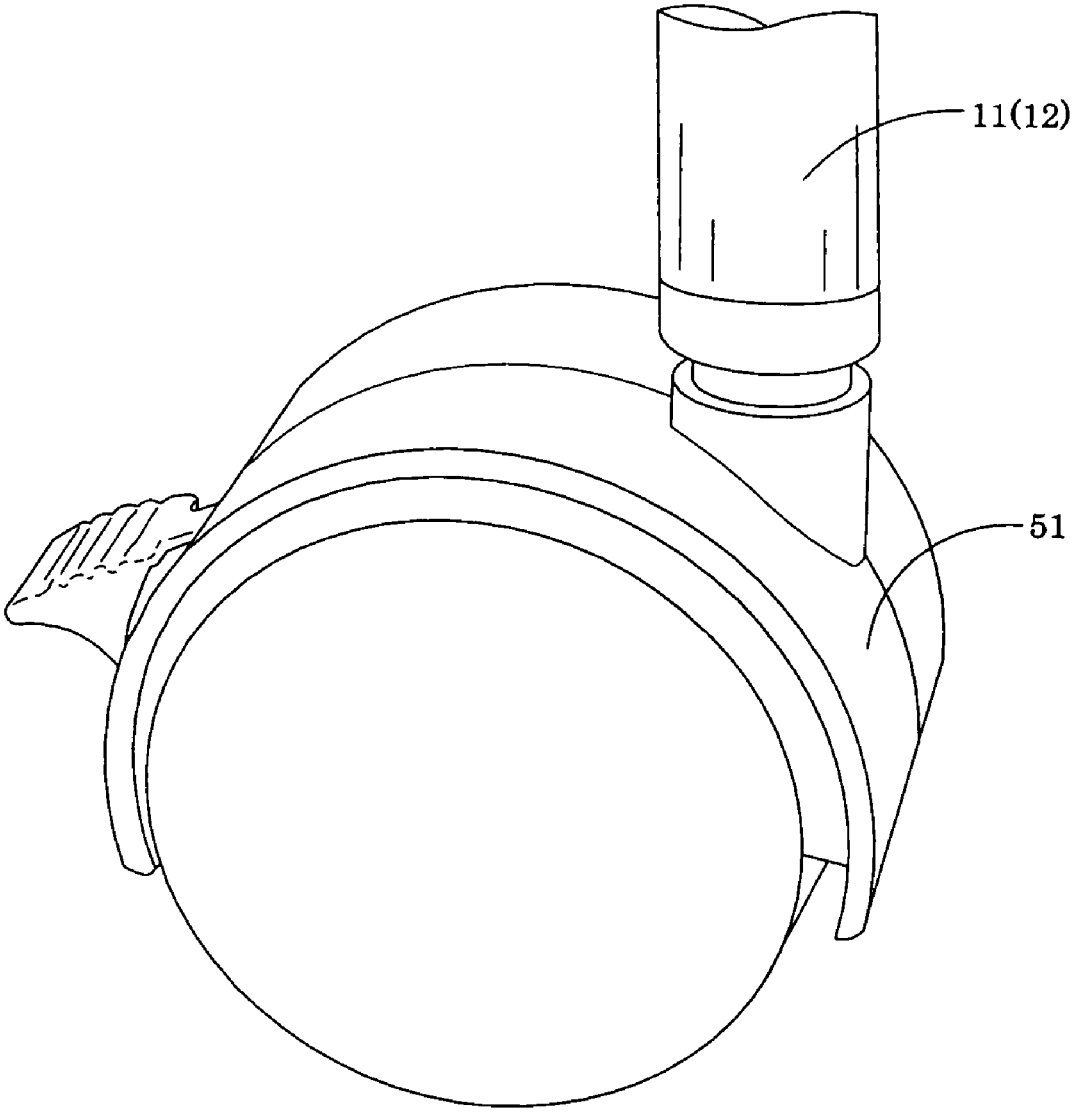
FIG. 8 is a perspective view of a wheel assembly of the foldable and portable storage shelf according to the above preferred embodiment of the present invention.

As shown in FIG. 7, the sliding joint 33 has a sliding through slot 331 for the transmission link 31 slidably passing therethrough and two side wings 332 extended sidewardly to pivotally couple with the upper ends of the folding arms 32 respectively.

The foldable frame 30 further comprises a retention stopper 34 provided at the upper end of the transmission link 31 to bias against the sliding joint 33 when the sliding joint 33 is slid at the upper end of the transmission link 31 at the unfolded position so as to prevent any further upward sliding movement of the sliding joint 33. Therefore, when the sliding joint 33 is upwardly slid and blocked by the retention stopper 34, the side frames 10 are folded at the unfolded position.

According to the preferred embodiment, the panel assembly 20 further comprises a top retention panel 22 coupling between the side frames 10. The top retention panel 22 has a width matching with the two side panels 211 of each of the foldable shelf panels 21. In other words, when the side panels 211 are folded edge-to-edge at the unfolded position, the overall width of the two side panels 211 is corresponding to the top retention panel 22.

As shown in FIG. 4, the top retention panel 22 has a pivotal side edge 221 pivotally coupling with one of the side frames 10 and an opposed detachable side edge 222 detachably coupling with another side frame 10. A width of the top retention panel 22, which is a distance between the pivotal side edge 221 and the detachable side edge 222, is correspondingly matching with the distance between the side frames 10 at the unfolded position.

Figure 6:
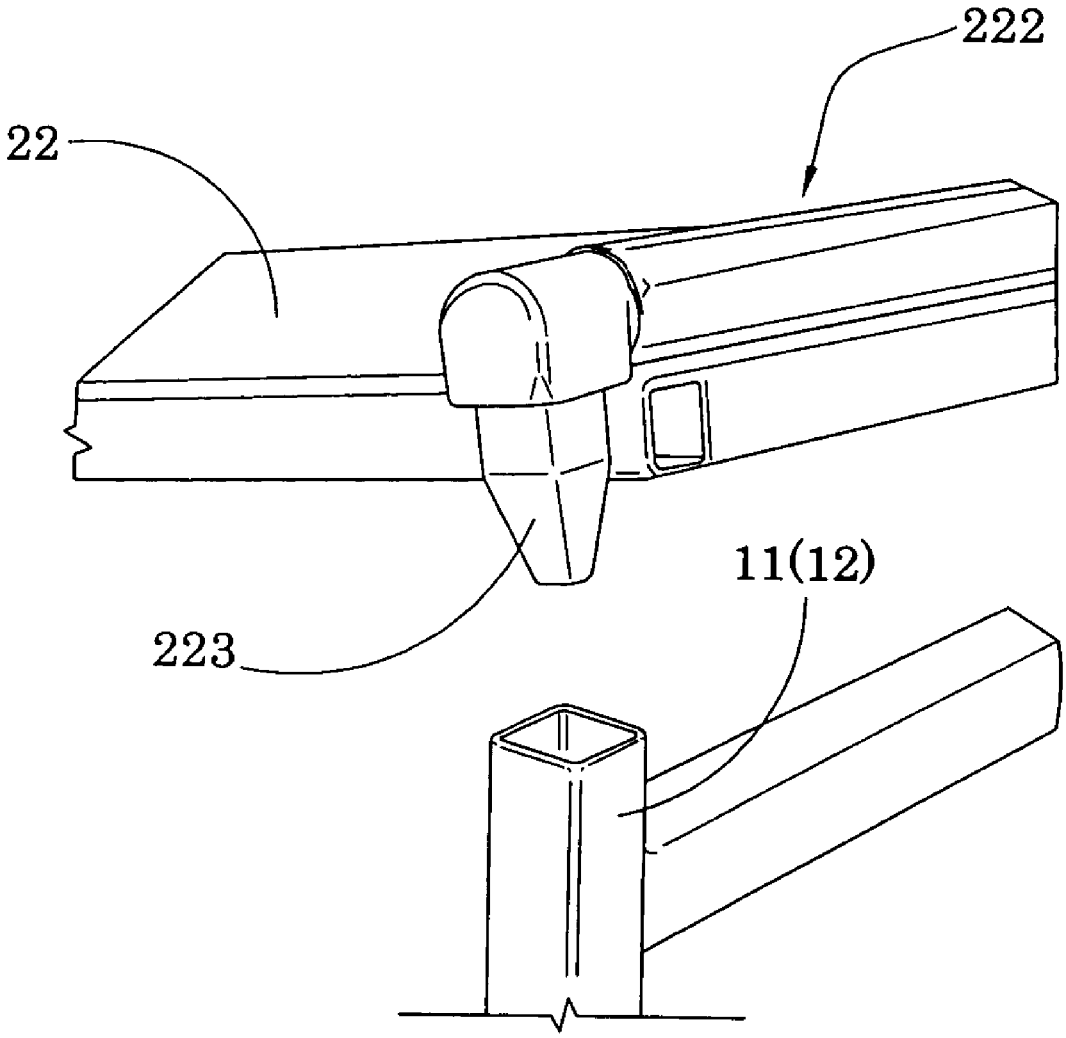
FIG. 6 is a partially perspective view of the top retention panel of the foldable and portable storage shelf according to the above preferred embodiment of the present invention.

As shown in FIG. 3, the pivotal side edge 221 of the top retention panel 22 is pivotally coupled between the front and rear supporting members 11, 12 of one of the side frames 10. The detachable side edge 222 of the top retention panel 22 is detachably coupled between the front and rear supporting members 11, 12 of another side frame 10. Accordingly, the top retention panels 22 comprises two detachable couplers 223 spacedly provided at the bottom side of the top retention panel 22 along the detachable side edge 222 thereof, wherein the detachable couplers 223 are detachably and slidably inserted into two upper ends of the front and rear supporting members 11, 12 of the respective side frame 10, as shown in FIG. 6.

Therefore, when the detachable couplers 223 are detachably and slidably inserted into two upper ends of the front and rear supporting members 11, 12 of the respective side frame 10, the distance between the side frames 10 are retained by the width of the top retention panel 22. When the detachable couplers 223 detach from the front and rear supporting members 11, 12 respectively, the two side frames 10 are adapted to be folded side-by-side. In other words, the top retention panel 22 not only forms a top shelf panel of the storage shelf but also forms a locker to lock up the side frames 10 at the unfolded position so as to retain the distance between the side frames 10.

It is appreciated that the top retention panel 22 can be entirely detached from the two side frames 10 by forming two detachable side edges 222 of the top retention panel 22. However, by forming one edge of the top retention panel 22 as the pivotal side edge 221, there is no detachable part of the storage shelf of the present invention so as to prevent any missing part thereof if the top retention panel 22 is lost.

The storage shelf of the present invention further comprises a shelf locker 40 for releasably locking the foldable frame 30 at the unfolded position. As shown in FIG. 7, the shelf locker 40 comprises a first locker 41 provided at the upper end of the transmission link 31 and a second locker 42 provided at the sliding joint 33 to releasably engage with the first locker 41 when the sliding joint 33 is slid to bias against the retention stopper 34. According to the preferred embodiment, the first locker 41 is preferably a locking latch provided at the retention stopper 34 at the upper end of the transmission link 31. The second locker 42 comprises a locking arm provided at the sliding joint 33 to releasably lock with the locking latch of the first locker 41 so as to lock up the sliding joint 33 at the upper end of the transmission link 31. It is appreciated that the first locker 41 can be provided at any location of the transmission link 31, for example, at an upper portion thereof, wherein the sliding joint 33 is slid along the transmission link 31 is locked at the transmission link 31 at a position where the foldable frame 30 is unfolded at its unfolded position.

It is worth to mention that three different mechanisms are used for retaining the foldable frame 30 at the unfolded position. Accordingly, the weight of the object will prevent the transmission link 31 from moving upwardly so as to ensure foldable frame 30 at the unfolded position. The top retention panel 22 will retain the distance between the side frames 10 when the top retention panel 22 is coupled at the upper ends of the supporting members 11, 12 so as to ensure foldable frame 30 at the unfolded position. In addition, the shelf locker 40 will prevent the sliding joint 33 from slidably moving away from the upper end of the transmission link 31 when the shelf locker 40 locks up the sliding joint 33 with the retention stopper 34, so as to ensure foldable frame 30 at the unfolded position.

The storage shelf of the present invention further comprises a wheel assembly 50 coupling with the side frames 10, wherein the wheel assembly 50 comprises a plurality of lockable wheels 51 coupling with the bottom ends of the supporting members 11, 12 respectively. Accordingly, the lockable wheels 51 enhance the mobility of the storage shelf. In addition, the lockable wheels 51 further enhance the side frames 10 moving between the folded position and the unfolded position. In other words, when the side frames 10 are moved away from each other to the unfolded position, the lockable wheels 51 will enhance the extending movement between the side frames 10 to maximize the distance therebetween. Likewise, when the side frames 10 are moved towards each other to the folded position, the lockable wheels 51 will enhance the folding movement between the side frames 10 to minimize the distance therebetween. It is worth to mention that the lockable wheels 51 can be locked to prevent any unwanted sliding movement of the side frames 10.

In order to unfold the storage shelf of the present invention from the folded position, the user is able to pull the side frames 10 from each other such that the sliding joint 33 is upwardly slid towards the upper end of the transmission link 31. At the same time, the foldable shelf panels 21 are pivotally and concurrently folded at a position that the corresponding side panels 211 of each of the foldable shelf panels 21 are folded edge-to-edge in a single planar configuration. Once the sliding joint 33 is slid to bias against the retention stopper 34, i.e. the unfolded position of the foldable frame 30, the shelf locker 40 can be utilized to lock up the foldable frame 30 at the unfolded position by engaging the second locker 42 with the first locker 41. Then, the top retention panel 22 can be coupled with the side frames 10 by pivotally folding the pivotal side edge 221 of the top retention panel 22 to detachably engage the detachable side edge 222 of the top retention panel 22 with the respective front and rear supporting members 11, 12.

For folding up the storage shelf, the user is able to detach the detachable side edge 222 of the top retention panel 22 from the respective front and rear supporting members 11, 12 and to pivotally fold the pivotal side edge 221 of the top retention panel 22 at another side frame 10. By unlocking the shelf locker 40, the user is able to pull the side frames 10 towards each other so as to fold up the storage shelf.

Figure 9:
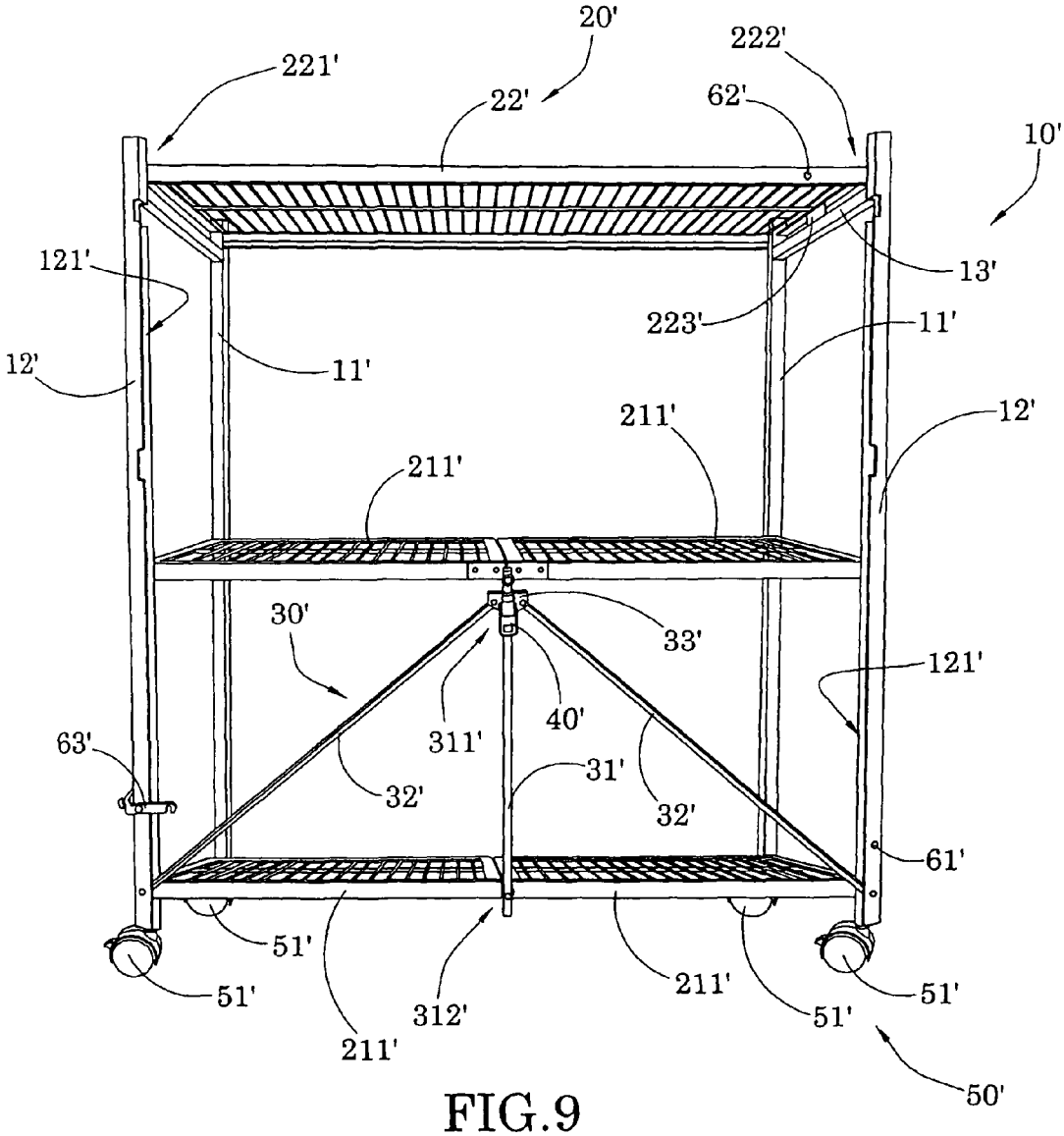
FIG. 9 is a rear perspective view of a foldable and portable storage shelf according to a second preferred embodiment of the present invention.

As shown in FIG. 9, a foldable and portable storage shelf of a second embodiment illustrates an alternative mode of the first embodiment, wherein the foldable storage shelf comprises two spaced apart side frames 10', a panel assembly 20', and a foldable frame 30'.

Similar to the first embodiment, the two side frames 10' of the second embodiment are identical. Each of the side frames 10' comprises two tubular supporting members 11', 12', i.e. front supporting member 11' and rear supporting member 12', spacedly supporting with each other in a vertical manner, such that the four supporting members 11', 12' form four supporting posts at four corners of the storage shelf respectively. In addition, the front and rear supporting members 11', 12' form an opened area therebetween. Each of the side frames 10' further comprises a top supporting member 13' extended between the upper portions of the front and rear supporting members 11', 12', and a bottom supporting member 14' extended between the bottom portions of the front and rear supporting members 11', 12'. Therefore, each of the side frames 10' generally forms a rectangular structure.

Figure 10:
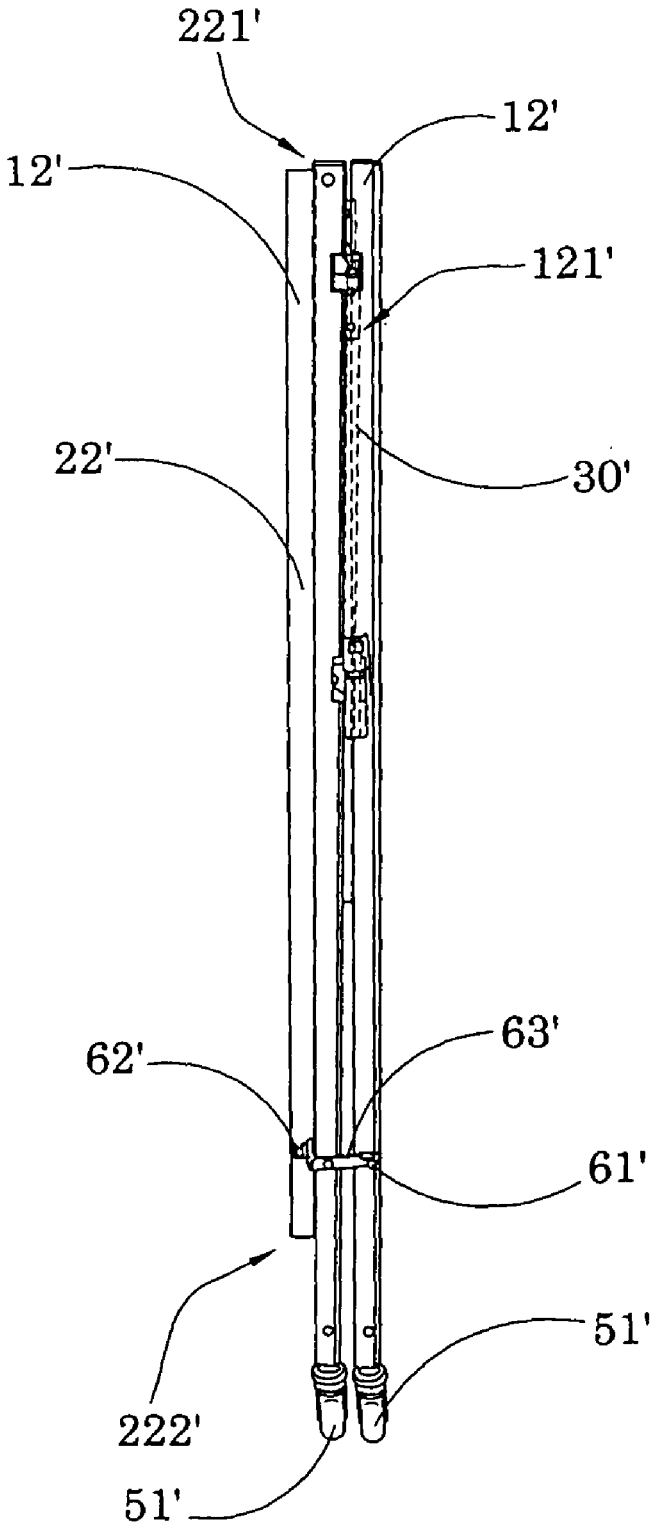
FIG. 10 is a side view of the foldable and portable storage shelf according to the above second embodiment of the present invention, illustrating the folded position of the foldable and portable storage shelf.

Accordingly, each of the rear supporting members 12' has a U-shaped cross sectional portion to define a receiving cavity 121'. As shown in FIGS. 9 and 10, the receiving cavity 121' is formed between the upper end and the bottom end of each of the rear supporting members 12', wherein each of the receiving cavities 121' has an elongated opening facing towards each other. In other words, when the foldable and portable storage shelf is folded up, the rear supporting members 12' are moved towards each other that the receiving cavities 121' are aligned to form an enlarged cavity.

The panel assembly 20' comprises a plurality of foldable shelf panels 21' spacedly and pivotally supported between the two side frames 11', wherein each of the foldable shelf panels 21' comprises two side panels 211' pivotally coupled with each other edge-to-edge to define a pivot point 210' between the two inner edges of the side panels 211'. The two side panels 211' are identical that the outer edges of the side panels 211' are pivotally coupled with the side frames 10' respectively such that when the two inner edges of the side panels 211' are pivotally folded, the two side panels 211' are overlapped with each other at the folded position. Preferably, the inner edges of the side panels 211' are upwardly folded to overlap the side panels with each other at the folded position. It is worth mentioning that the outer edges of the side panels 221' are pivotally coupled with the inner sides of the side frames 10' respectively such that when the side panels 211' are folded at the folded position, the side panels 211' are retained between the front and rear supporting members 11', 12'.

Accordingly, a width of each of the foldable shelf panels 21' correspondingly matches with a distance between the two supporting members 11' of each of the side frames 10' such that the foldable shelf panels 21' are securely supported by the supporting members 11' of the side frames 10'. As shown in FIG. 9, there are two foldable shelf panels 21' being supported between the two side frames 10'.

In addition, each of the foldable shelf panels 21' is formed to have a net shaped configuration, wherein an additional panel can be added onto each of the foldable shelf panels 21' to provide a flat supporting surface thereon.

The foldable frame 30' is pivotally coupled between the two side frames 10' to fold between the unfolded position and the folded position. At the unfolded position, as shown in FIG.

Figure 11:
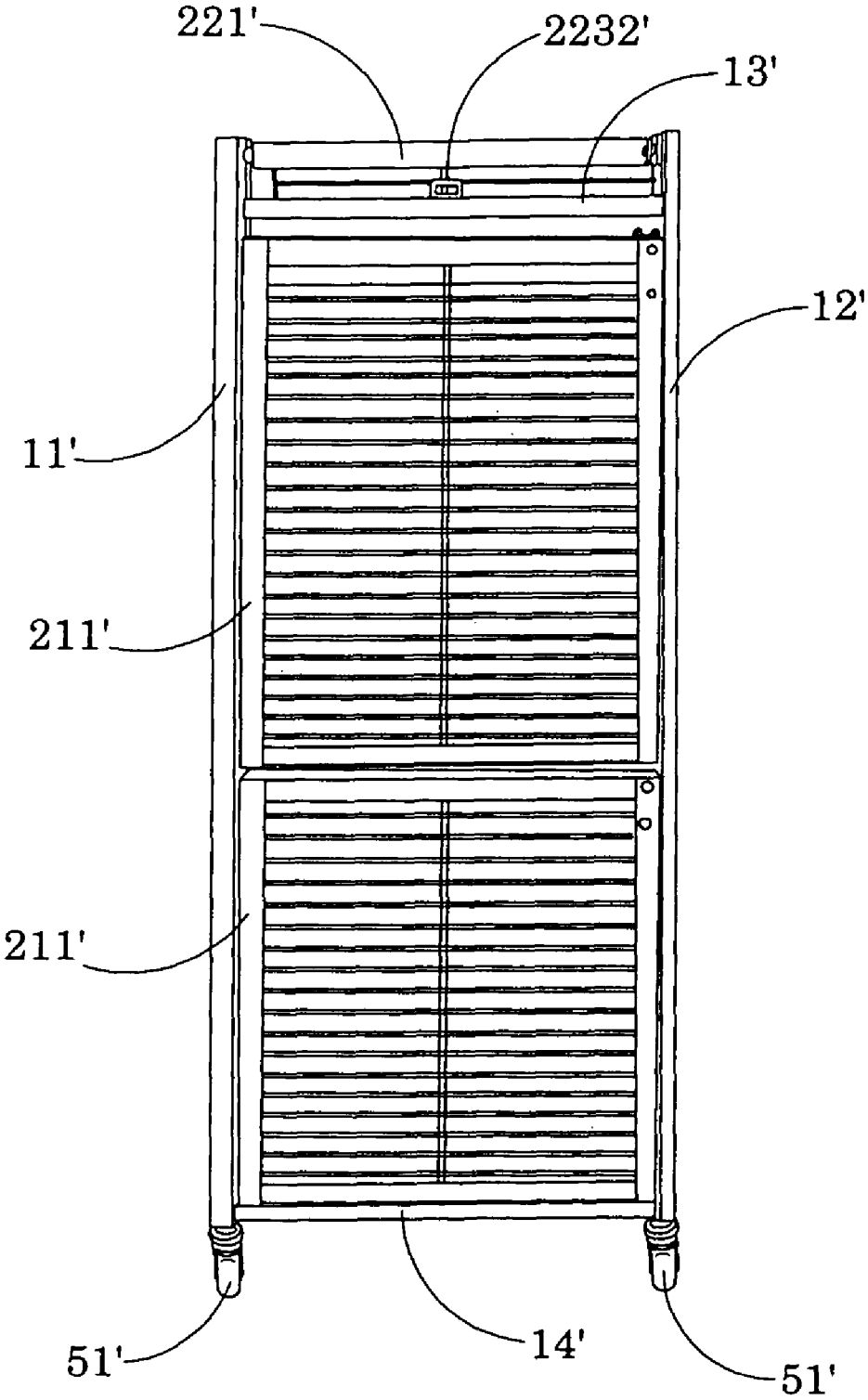
FIG. 11 is a front view of the foldable and portable storage shelf according to the above second embodiment of the present invention, illustrating the folded position of the foldable and portable storage shelf.

9, the side frames 10' are pivotally moved apart from each other to retain each of the foldable shelf panels 21' in a horizontal manner. In other words, at the unfolded position, the foldable shelf panels 21' are spacedly and transversely extended between the two side frames 10' such that the object can be placed at the foldable shelf panels 21'. At the folded position, as shown in FIGS. 10 and 11, the side frames 10' are pivotally moved towards each other such that each of the foldable shelf panels 21' is folded in an overlapped manner. In other words, at the folded position, the side frames 10' are moved towards each other to minimize a distance between the side frames 10' while the foldable shelf panels 21' are folded parallel to the side frames 10'. In addition, each of the foldable shelf panels 21' is folded between the front and rear supporting members 11', 12' while the front and rear supporting members 11', 12' are moved side-by-side to form the compact structure at the folded position.

According to the preferred embodiment, the foldable frame 30' comprises a transmission link 31' pivotally coupling with the pivot points 210' of the foldable shelf panels 21' and two folding arms 32' movably coupling the transmission link 31' to the side frames 21' respectively to retain the distance between the side frames 10' at the unfolded position.

As shown in FIG. 9, the transmission link 31' is an elongated member vertically supported between the two side frames 10', wherein the transmission link 31' has an upper end 311' coupling with the uppermost foldable shelf panel 21' at the pivot point 210' thereof and a lower end 312' coupling with the lowermost foldable shelf panel 21' at the pivot point 210' thereof. In particularly, when the transmission link 31' is moved upwardly at a vertical direction, the foldable shelf panels 21' are pivotally and concurrently folded to overlap the two corresponding side panels 211' of each of the foldable shelf panels 21' with each other. Likewise, when the transmission link 31' is moved downwardly at a vertical direction, the foldable shelf panels 21' are pivotally and concurrently folded at a position that the corresponding side panels 211' of each of the foldable shelf panels 21' are folded edge-to-edge in a single planar configuration.

Accordingly, the transmission link 31' is aligned between the receiving cavities 121' of the rear supporting members 12', wherein when the foldable frame 30' is folded at the folded position, the transmission link 31' is enclosed within the receiving cavities 121' of the rear supporting members 12'. Therefore, the front supporting members 11' are folded side-by-side and the rear supporting members 12' are also folded side-by-side to minimize the distance between the two side frames 10'.

The foldable frame 30' further comprises a sliding joint 33' slidably coupling with the transmission link 31' such that the sliding joint 33' is adapted to slide along the transmission link 31' between the upper end and the lower end. Accordingly, when the foldable frame 30' is folded to its folded position, the sliding joint 33' is slid along the transmission link 31' away from the upper end thereof. When the foldable frame 30' is folded to its unfolded position, the sliding joint 33' is slid along the transmission link 31' at the upper end thereof Accordingly, since the sliding joint 33' is slidably coupled at the transmission link 31', the sliding joint 33' will be enclosed within the receiving cavities 121' when the foldable frame 30' is folded at the folded position.

Each of the folding arms 32' has an upper end pivotally coupling with the sliding joint 33' and a lower end pivotally coupling with the rear supporting member 12 of the corresponding side frame 10'. In particularly, the lower end of each of the folding arms 32' is pivotally coupled at the inner wall of the respective receiving cavity 121' of the rear supporting member 12', wherein the lower end of the folding arm 32' is pivotally connected to the rear supporting member 12' at a position where the outer edge of the side panel 211' of the lowermost foldable shelf panels 21' pivotally connected to the rear supporting member 12'. In other words, the outer edge of the side panel 211', the rear supporting member 12' and the lower end of the folding arm 32' are pivotally connected via one single pivot shaft.

Accordingly, the sliding joint 33' has a sliding through slot 331' for the transmission link 31' slidably passing therethrough and two side wings 332' extended sidewardly to pivotally couple with the upper ends of the folding arms 32' respectively.

Furthermore, the two folding arms 32' are aligned between the receiving cavities 121' of the rear supporting members 12' such that when the foldable frame 30' is folded at the folded position, the folding arms 32' are enclosed within the receiving cavities 121'. It is worth mentioning that when the foldable frame 30' is folded at the folded position, the transmission link 31', the two folding arms 32' and the sliding joint 33' are enclosed within the receiving cavities 121' of the rear supporting members 12'.

As shown in FIG. 10, when the two side frames 10' are folded towards each other, i.e. the folded position, the transmission link 31' is vertically and upwardly moved to fold up the foldable shelf panels 21'. At the same time, the sliding joint 33' is slid away from the upper end of the transmission link 31' to ensure the two side frames 10' being folded side-by-side. When the foldable frame 30' is folded at the unfolded position, the transmission link 31' is vertically and downwardly moved to unfold the foldable shelf panels 21'. At the same time, the sliding joint 33' is slid at the upper end of the transmission link 31' to fully extend the distance between the side frames 10'.

Each of the folding arms 32' is extended in an inclined manner to form a triangular configuration between the side frames 10' and the transmission link 31' so as to provide a rigid support of the panel assembly 20'. In addition, when the object is placed on the folding shelf panel 21', the downward force of the object, i.e. the weight of the object, is substantially exerted on the folding shelf panel 21' to the transmission link 31', so as to ensure the foldable frame 30' being folded at the unfolded position. In other words, the downward force of the object will prevent the foldable frame 30' from being folded back to its folded position accidentally.

The foldable frame 30' further comprises a retention stopper 34' provided at the upper end of the transmission link 31' to bias against the sliding joint 33' when the sliding joint 33' is slid at the upper end of the transmission link 31' at the unfolded position so as to prevent any further upward sliding movement of the sliding joint 33'. Therefore, when the sliding joint 33' is upwardly slid and blocked by the retention stopper 34', the side frames 10' are folded at the unfolded position.

According to the preferred embodiment, the panel assembly 20' further comprises a top retention panel 22' coupling between the side frames 10'. The top retention panel 22' has a width matching with the two side panels 211' of each of the foldable shelf panels 21'. In other words, when the side panels 211' are folded edge-to-edge at the unfolded position, the overall width of the two side panels 211' is corresponding to the top retention panel 22'.

As shown in FIGS. 9 and 10, the top retention panel 22' has a pivotal side edge 221' pivotally coupling with one of the side frames 10' and an opposed detachable side edge 222' detachably coupling with another side frame 10'. A width of the top retention panel 22', which is a distance between the pivotal side edge 221' and the detachable side edge 222', is correspondingly matching with the distance between the side frames 10' at the unfolded position. When the foldable frame 30' is folded at the folded position, the top retention panel 22' is outwardly folded to overlap with the respective side frame 10'. In other words, at the folded position, the top retention panel 22' is parallel to the side frames 10' to minimize the overall size of the foldable and portable storage shelf.

Figure 12:
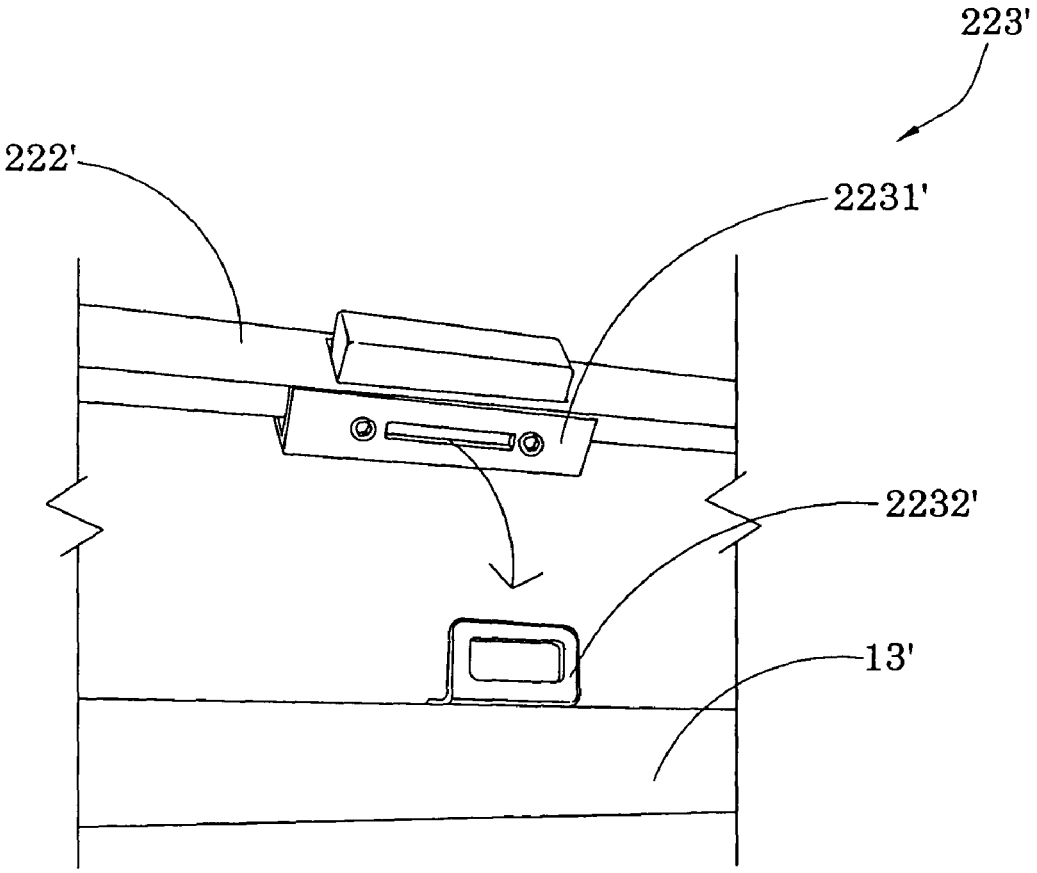
FIG. 12 is a perspective view of a panel locker of the foldable and portable storage shelf according to the above second embodiment of the present invention.

As shown in FIG. 9, the pivotal side edge 221' of the top retention panel 22' is pivotally coupled between the front and rear supporting members 11', 12' of one of the side frames 10'. The detachable side edge 222' of the top retention panel 22' is detachably coupled between the front and rear supporting members 11', 12' of another side frame 10'. Accordingly, the top retention panels 22' comprises a panel locker 223' provided at the bottom side of the top retention panel 22' along the detachable side edge 222' thereof, wherein the panel locker 223' is detachably coupled at the respective side frame 10'. As shown in FIG. 12, the panel locker 223' comprises a latch member 2231' provided at the top supporting member 13' of the respective side frame 10' and a releasable lock 2232' provided at the detachable side edge 222' of the top retention panel 22' to detachably couple with the latch member 2231'. In other words, when the top retention panel 22' is folded between the two side frames 10' to detachably engage the releasable lock 2232' with the latch member 2231', the distance between the side frames 10' are retained by the width of the top retention panel 22'. When the releasable lock 2232' detaches from the latch member 2231', the two side frames 10' are adapted to be folded side-by-side. In other words, the top retention panel 22' not only forms a top shelf panel of the storage shelf but also forms a locker to lock up the side frames 10' at the unfolded position so as to retain the distance between the side frames 10'.

Figure 13:
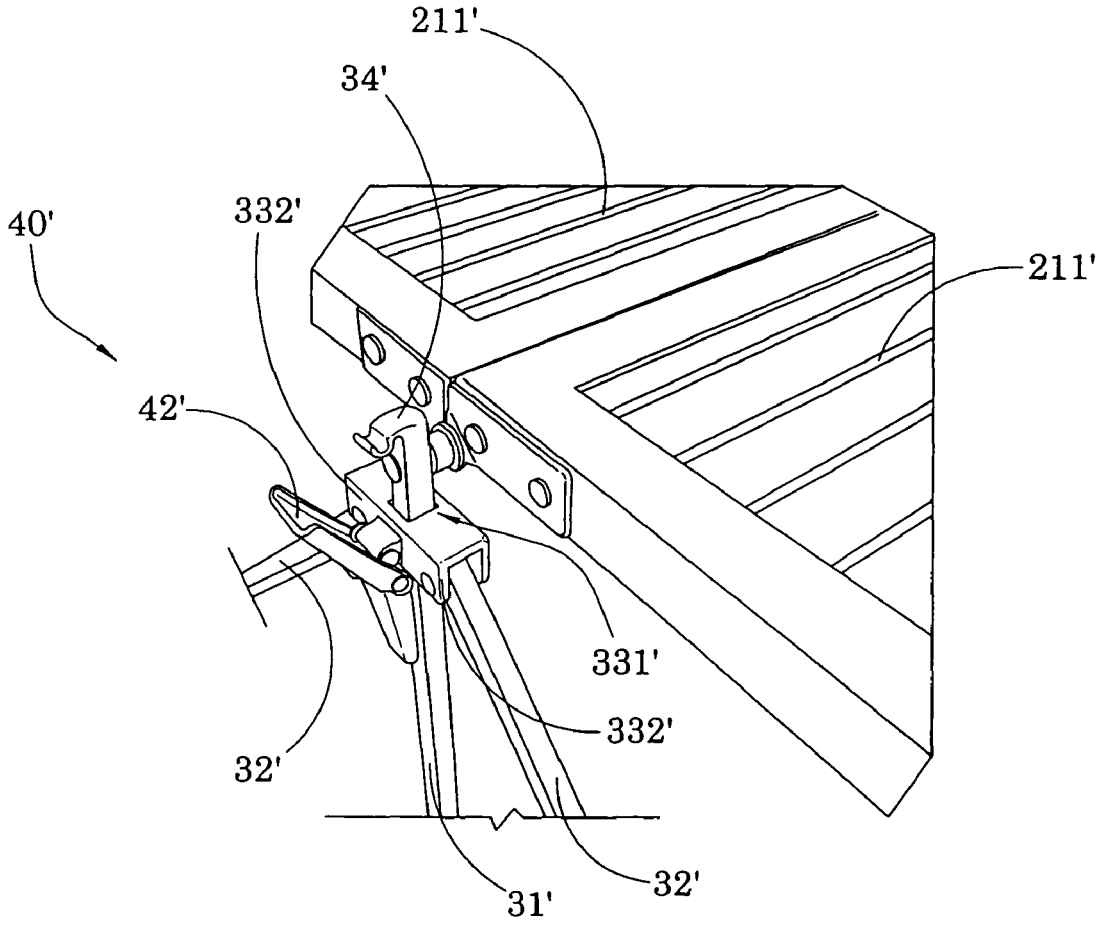
FIG. 13 is a perspective view of a shelf locker of the foldable and portable storage shelf according to the above second embodiment of the present invention.

The storage shelf of the present invention further comprises a shelf locker 40' for releasably locking the foldable frame 30' at the unfolded position. As shown in FIG. 13, the shelf locker 40' comprises a first locker 41' provided at the upper end of the transmission link 31' and a second locker 42' provided at the sliding joint 33' to releasably engage with the first locker 41' when the sliding joint 33' is slid to bias against the retention stopper 34'. According to the preferred embodiment, the first locker 41' is preferably a locking latch provided at the retention stopper 34' at the upper end of the transmission link 31'. The second locker 42' comprises a locking arm provided at the sliding joint 33' to releasably lock with the locking latch of the first locker 41' so as to lock up the sliding joint 33' at the upper end of the transmission link 31'. It is appreciated that the first locker 41' can be provided at any location of the transmission link 31', for example, at an upper portion thereof, wherein the sliding joint 33' is slid along the transmission link 31' is locked at the transmission link 31' at a position where the foldable frame 30' is unfolded at its unfolded position.

The storage shelf of the present invention further comprises a wheel assembly 50' coupling with the side frames 10', wherein the wheel assembly 50' comprises a plurality of lockable wheels 51' coupling with the bottom ends of the supporting members 11', 12' respectively. Accordingly, the lockable wheels 51' enhance the mobility of the storage shelf. In addition, the lockable wheels 51' further enhance the side frames 10' moving between the folded position and the unfolded position. In other words, when the side frames 10' are moved away from each other to the unfolded position, the lockable wheels 51' will enhance the extending movement between the side frames 10' to maximize the distance therebetween. Likewise, when the side frames 10' are moved towards each other to the folded position, the lockable wheels 51' will enhance the folding movement between the side frames 10' to minimize the distance therebetween. It is worth to mention that the lockable wheels 51' can be locked to prevent any unwanted sliding movement of the side frames 10'.

Figure 14:
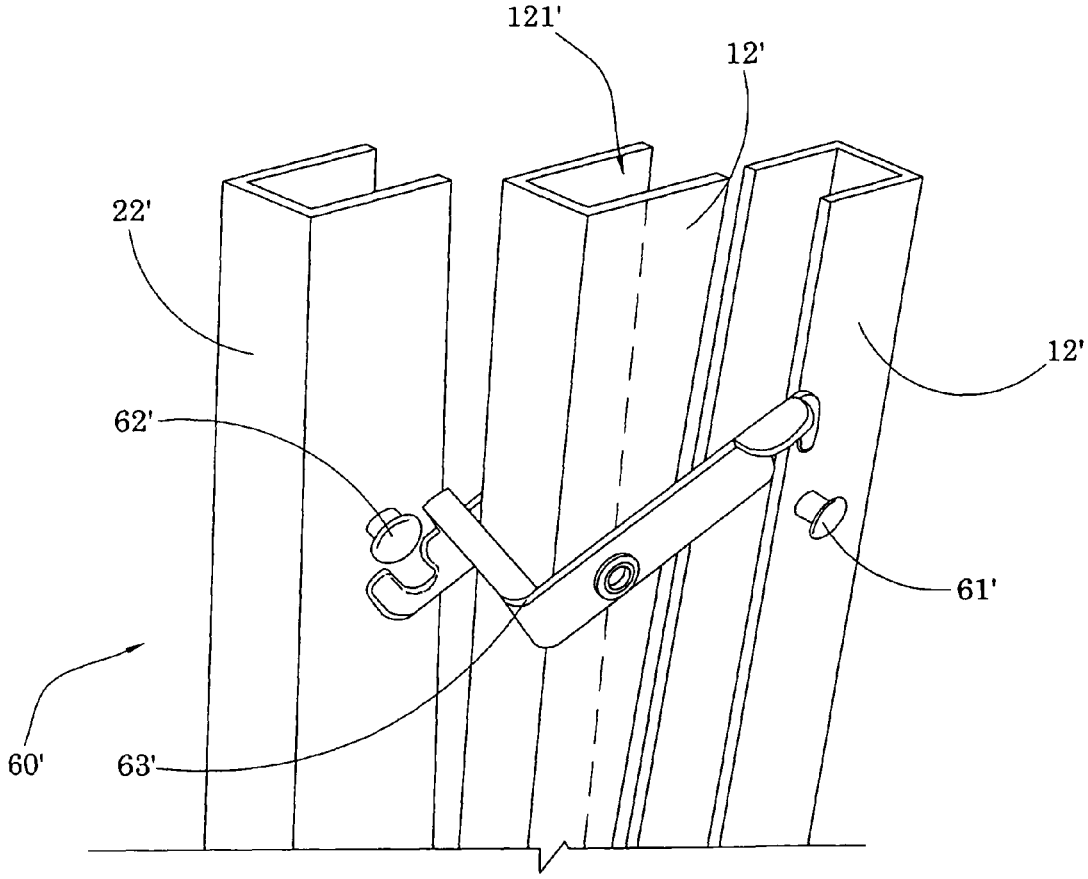
FIG. 14 is a perspective view of a frame locker of the foldable and portable storage shelf according to the above second embodiment of the present invention.

The storage shelf of the present invention further comprises a frame locker 60' for releasably locking the side frames 10' with the top retention panel 22' at the folded position. As shown in FIG. 14, the frame locker 60' comprises a first locking element 61' provided at one of the rear supporting members 12', a second locking element 62' provided at the top retention panel 22', and a pivot locker 63' pivotally coupled at another rear supporting member 12', wherein when the pivot locker 63' is pivotally moved in a transverse position, the pivot locker 63' is concurrently engaged with the first and second locking elements 61', 62'.

According to the preferred embodiment, the pivot locker 63' has two locking ends to detachably engage with the first and second locking elements 61', 62' respectively, wherein a pivot point of the pivot locker 63' is located between the two locking ends of the pivot locker 63'. In other words, when the pivot locker 63' is pivotally folded to align with the respective rear supporting member 12', the two locking ends of the pivot locker 63' are concurrently disengaged with the first and second locking elements 61', 62' respectively. When the pivot locker 63' is pivotally folded to transversely extend with respect to the rear supporting member 12', the two locking ends of the pivot locker 63' are concurrently engaged with the first and second locking elements 61', 62' respectively. It is worth mentioning that the pivot locker 63' is bent in a zigzag configuration that the two locking ends of the pivot locker 63' are aligned with the first and second locking elements 61', 62' respectively. Therefore, the storage shelf of the present invention requires one single frame locker 60' to lock up the two side frames 10' and the top retention panel 22' in a concurrent manner.

In order to unfold the storage shelf of the present invention from the folded position, the user is able to pull the side frames 10' from each other such that the sliding joint 33' is upwardly slid towards the upper end of the transmission link 31'. At the same time, the foldable shelf panels 21' are pivotally and concurrently folded at a position that the corresponding side panels 211' of each of the foldable shelf panels 21' are folded edge-to-edge in a single planar configuration. Once the sliding joint 33' is slid to bias against the retention stopper 34', i.e. the unfolded position of the foldable frame 30', the shelf locker 40' can be utilized to lock up the foldable frame 30' at the unfolded position by engaging the second locker 42' with the first locker 41'. Then, the top retention panel 22' can be coupled with the side frames 10' by pivotally folding the pivotal side edge 221' of the top retention panel 22' to detachably engage the detachable side edge 222' of the top retention panel 22' with the respective side frame 10' via the panel locker 223'.

For folding up the storage shelf, the user is able to detach the detachable side edge 222' of the top retention panel 22' from the respective side frame 10' and to pivotally fold the pivotal side edge 221' of the top retention panel 22' at another side frame 10'. By unlocking the shelf locker 40', the user is able to pull the side frames 10' towards each other so as to fold up the storage shelf. It is worth mentioning that the transmission link 31', the two folding arms 32' and the sliding joint 33' are enclosed within the receiving cavities 121' of the rear supporting members 12' when the storage shelf is folded at the folded position, the supporting members 11', 12' are moved close enough side-by-side to form the compact size of the storage shelf.

Figure 15:
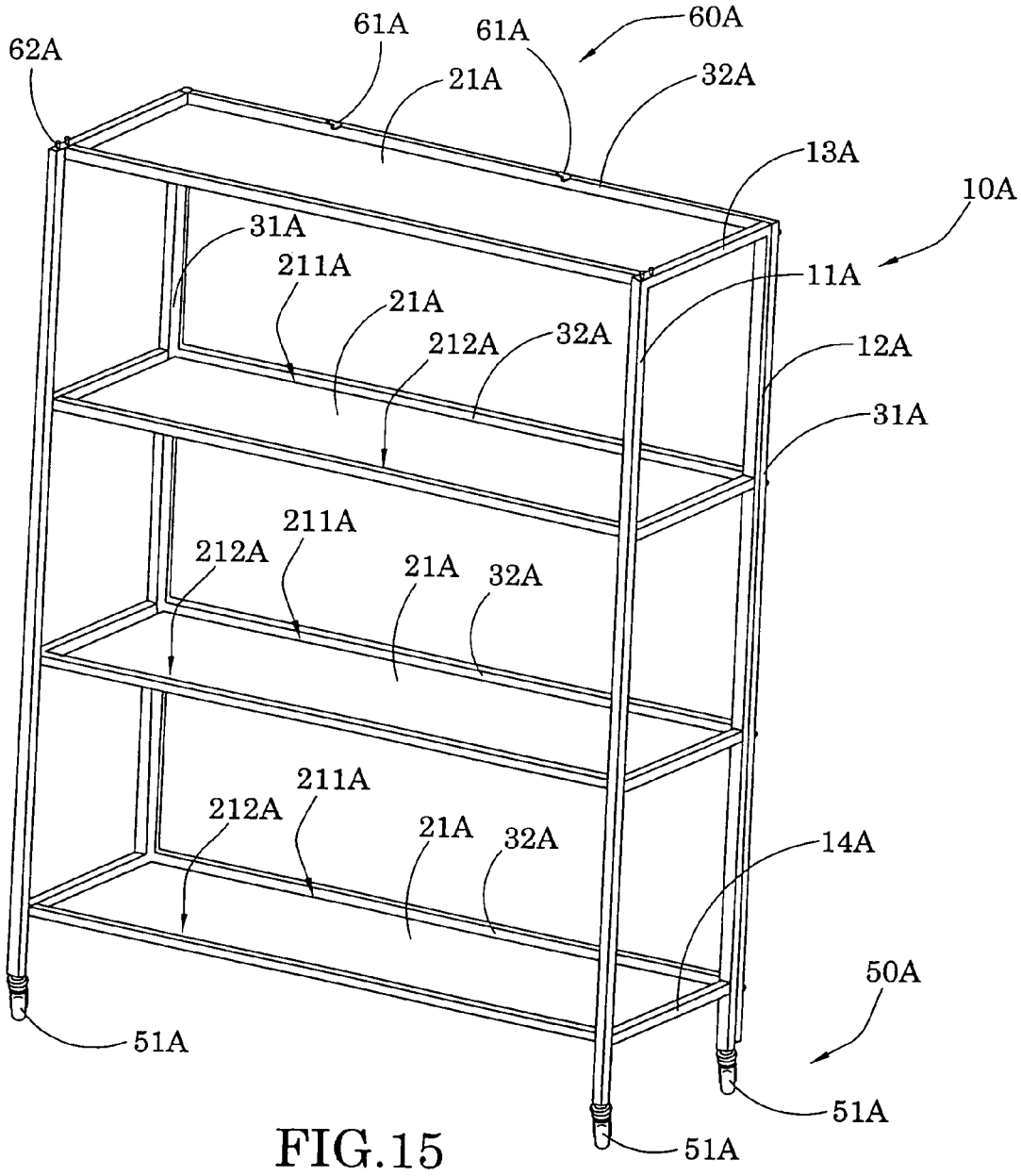
FIG. 15 is a perspective view of a foldable and portable storage shelf according to a third embodiment of the present invention.

As shown in FIG. 15, a foldable and portable storage shelf of a third embodiment illustrates another alternative mode of the first embodiment, wherein the storage shelf comprises two spaced apart side frames 10A, a panel assembly 20A, and a foldable frame 30A.

The foldable frame 30A is operatively coupled with the side frames 10A to fold the panel assembly 20A between an unfolded position and a folded position. At the unfolded position, the panel assembly 20A is rigidly supported between the side frames 10A to form a shelf structure for supporting an object. In addition, at the unfolded position, the foldable portable storage shelf provides three opened sides, i.e. the front side, left side, and right side, for being accessed. At the folded position, the panel assembly 20A is folded to minimize an overall size of the foldable and portable storage shelf.

Accordingly, the two side frames 10A are identical. Each of the side frames 10A comprises two tubular supporting members 11A, 12A, i.e. front supporting member 11A and rear supporting member 12A, spacedly supporting with each other in a vertical manner, such that the four supporting members 11A, 12A form four supporting posts at four corners of the storage shelf respectively. In addition, the front and rear supporting members 11A, 12A form an opened area therebetween.

Each of the side frames 10A further comprises a top supporting member 13A extended between the upper portions of the front and rear supporting members 11A, 12A, and a bottom supporting member 14A extended between the bottom portions of the front and rear supporting members 11A, 12A. Therefore, each of the side frames 10A generally forms a rectangular structure.

The panel assembly 20A comprises a plurality of foldable shelf panels 21A spacedly and pivotally supported between the two side frames 11A, wherein at the unfolded position, the foldable shelf panels 21A are parallel with each other and are securely supported between the side frames 10A that each of the foldable shelf panels 21A is extended between the front and rear supporting members 11A, 12A. At the folded position, the foldable shelf panels 21A are pivotally folded to form a planar configuration. As shown in FIG. 15, there are four foldable shelf panels 21A being supported between the two side frames 10A.

Figure 16:
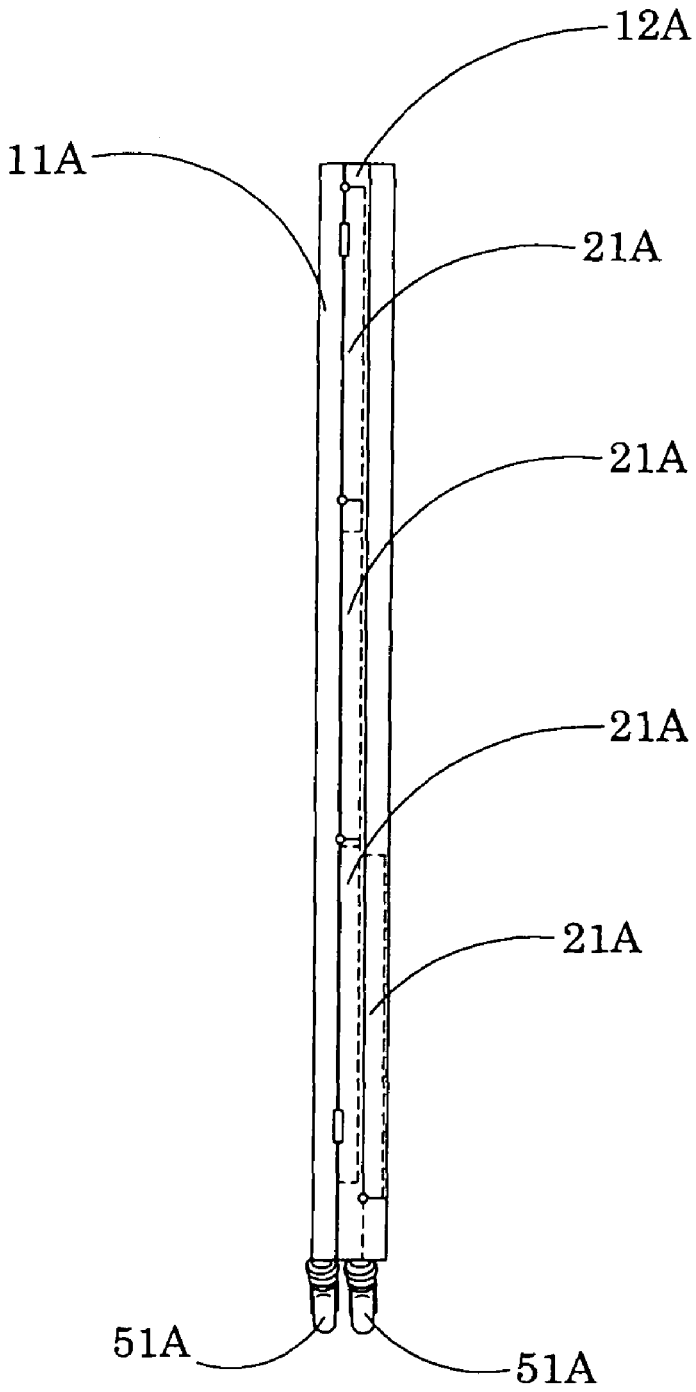
FIG. 16 is a side view of the foldable and portable storage shelf according to the above third embodiment of the present invention, illustrating the folded position of the foldable and portable storage shelf.
Figure 17:
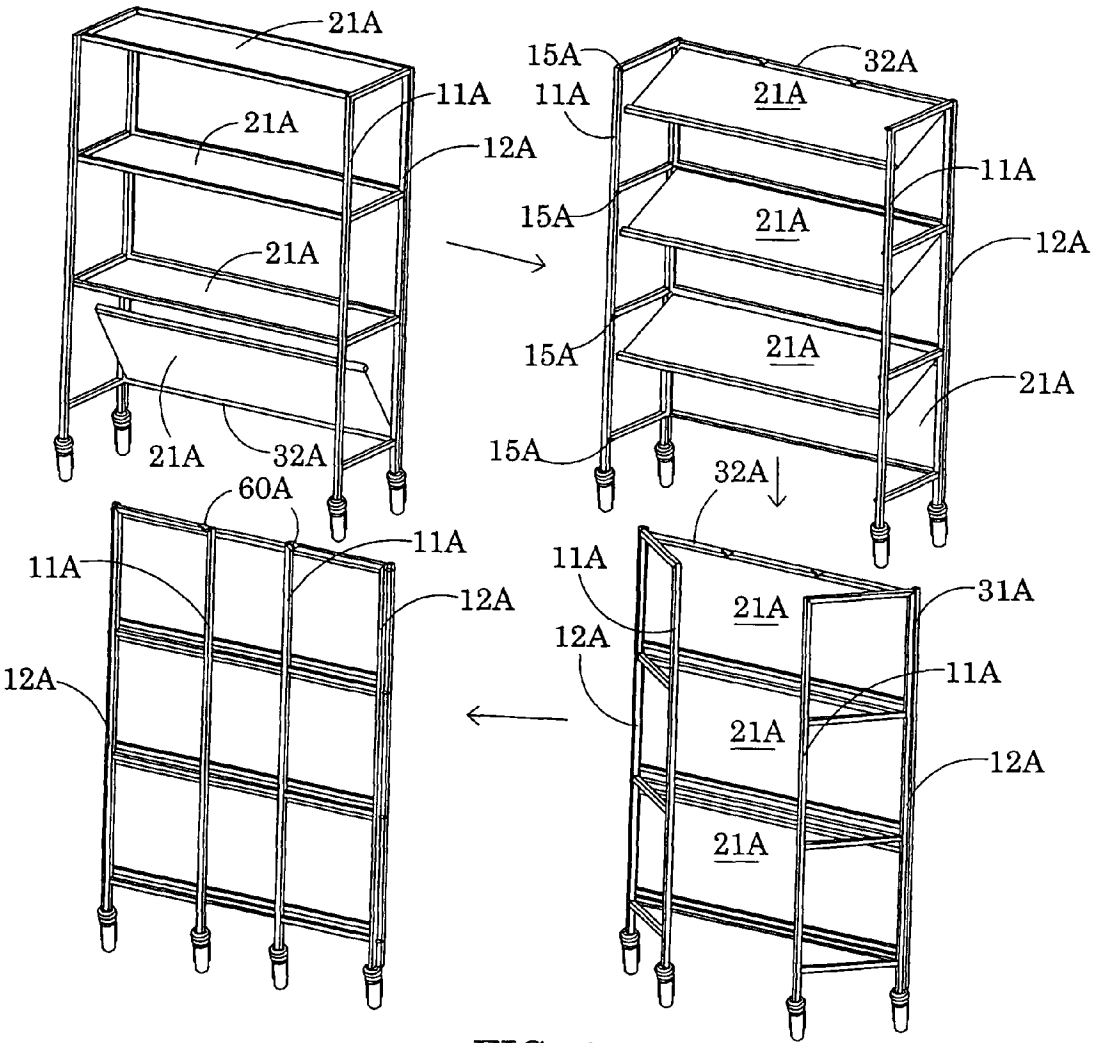
FIG. 17 illustrates a folding operation of the foldable and portable storage shelf according to the above third embodiment of the present invention.

The foldable frame 30A is pivotally coupled between the two side frames 10A to fold between the unfolded position and the folded position. At the unfolded position, as shown in FIG. 15, the side frames 10A are pivotally moved apart from each other and are parallel with each other to retain each of the foldable shelf panels 21A between the side frames 10A in a horizontal manner. In other words, at the unfolded position, the side frames 10A are parallelly and spacedly supported that the foldable shelf panels 21A are spacedly and transversely extended between the two side frames 10A such that the object can be placed at the foldable shelf panels 21A. At the folded position, as shown in FIGS. 16 and 17, the side frames 10A are pivotally moved towards each other such that the side frames 10A are folded side-by-side. In other words, at the folded position, the front supporting members 11A are parallely aligned side-by-side to minimize a distance between the front supporting members 11A of the side frames 10A while the foldable shelf panels 21A are folded between the rear supporting members 12A.

The foldable frame 30A comprises two side members 31A pivotally coupling with the rear supporting members 12A respectively and a backing frame extended between the side members 31A. Accordingly, the backing frame comprises a plurality of transmission links 32A extended between the side members 31A, wherein the two side frames 10A are adapted to pivotally fold on the transmission links 32A of the backing frame at the folded position.

According to the third embodiment, each of the foldable shelf panels 21A has a rear pivot edge 211A pivotally coupled with the backing frame to pivotally fold between the unfolded position and the folded position. In particularly, the rear pivot edges 211A of the foldable shelf panels 21A are pivotally coupled with the transmission links 32A respectively to pivotally fold between the unfolded position that the foldable shelf panels 21A are perpendicularly extended from the backing frame and the folded position that the foldable shelf panels 21A are overlapped on the backing frame. Accordingly, at the unfolded position, a front detachable edge 212A of each of the foldable shelf panels 21A is folded to detachably couple at the front supporting members 11A such that the foldable shelf panels 21A are parallelly supported between the front and rear supporting members 11A, 12A. At the folded position, the front detachable edge 212A of each of the foldable shelf panels 21A is detached from the front supporting members 11A such that the foldable shelf panels 21A are adapted to be pivotally folded at a position that two side edges 213A of each of the foldable shelf panels 21A are aligned between the side members 31A.

Accordingly, a width of each of the foldable shelf panels 21A correspondingly matches with a distance between the two supporting members 11A, 12A of each of the side frames 10A such that the foldable shelf panels 21A are securely supported by the supporting members 11A, 12A of the side frames 10A. In addition, the width of each of the foldable shelf panels 21A is smaller than a vertical distance between two transmission links 32A.

According to the third embodiment, the top three foldable shelf panels 21A are downwardly and rearwardly folded towards the transmission links 32A when the front detachable edges 212A of the foldable shelf panels 21A are detached from the front supporting members 11A. When the top three foldable shelf panels 21A are folded at the folded position, the top three foldable shelf panels 21A form a planer configuration between the side members 31A. In addition, the width of each of the foldable shelf panels 21A is smaller than a distance between two transmission links 32A such that when the foldable shelf panel 21A is folded at the folded position, the foldable shelf panel 21A is disposed within the two side members 31A and the two corresponding transmission links 32A.

As shown in FIG. 17, the bottom foldable shelf panel 21A is upwardly and rearwardly folded towards the transmission links 32A when the front detachable edge 212A of the bottom foldable shelf panel 21A is detached from the front supporting members 11A. Therefore, after the bottom foldable shelf panel 21A is pivotally folded between the side members 31A, the top three foldable shelf panels 21A can be pivotally folded between the side members 31A such that the third foldable shelf panel 21A will be overlapped with the bottom foldable shelf panel 21A at the folded position.

The side frame 10A further comprises a plurality of panel supporters 15A for supporting the front detachable edges 212A of the foldable shelf panels 21A at the front supporting members 11A in a detachably coupling manner. Accordingly, the panel supporters 15A are spacedly provided at each of the front supporting members 11A to align with the orientation of the foldable shelf panels 21A at the unfolded position, such that when the foldable shelf panels 21A are folded at the unfolded position, the front detachable edges 212A of the foldable shelf panels 21A are detachably supported by the panel supporters 15A to retain the foldable shelf panels 21A at a horizontal level. It is worth mentioning that the panel supporters 15A are detachably coupled at the bottom sides of the foldable shelf panels 21A such that each of the panel supporters 15A not only forms a support to maintain the respective foldable shelf panel 21A at the unfolded position but also forms a locker to lock up the respective foldable shelf panel 21A at the unfolded position.

It is worth mentioning that when the side frames 10A are pivotally folded to overlap with the foldable frame 30A, the foldable shelf panels 21A are sandwiched between the side frames 10A and the transmission links 32A of the backing frame.

The storage shelf of the present invention further comprises a frame locker 60A for releasably locking the foldable frame 30A at the unfolded position. As shown in FIG. 17, the frame locker 60A comprises one or more first lockers 61A spacedly provided at the upper end of the uppermost transmission link 32A and a second locker 62A provided at each of the top supporting members 13A such that when the side frames 10A are pivotally folded to overlap on the transmission links 32A of the backing frame, the second lockers 62A are detachably engaged with the first lockers 61A to retain the side frames 10A at the folded position. It is worth mentioning that since the side frames 10A are locked by the frame locker 60A, the foldable shelf panels 21A will be securely sandwiched between the side frames 10A and the transmission links 32A of the backing frame.

The storage shelf of the present invention further comprises a wheel assembly 50A coupling with the side frames 10A, wherein the wheel assembly 50A comprises a plurality of lockable wheels 51A coupling with the bottom ends of the supporting members 11A, 12A respectively. Accordingly, the lockable wheels 51A enhance the mobility of the storage shelf. In addition, the lockable wheels 51A further enhance the side frames 10A moving between the folded position and the unfolded position. In other words, when the side frames 10A are pivotally moved away from each other to the unfolded position, the lockable wheels 51A will enhance the extending movement between the side frames 10A to pivotally fold perpendicularly to the backing frame. Likewise, when the side frames 10A are moved towards each other to the folded position, the lockable wheels 51A will enhance the folding movement between the side frames 10A to overlap on the backing frame of the foldable frame 30A. It is worth to mention that the lockable wheels 51A can be locked to prevent any unwanted sliding movement of the side frames 10A.

In order to unfold the storage shelf of the present invention from the folded position, the user is able to pivotally pull out the side frames 10A from the backing frame of the foldable frame 30A as a door opening motion until the side frames 10A are perpendicularly extended from the backing frame of the foldable frame 30A. Then, the user is able to pivotally lift up the foldable shelf panels 21A at the front detachable edges 212A thereof from the backing frame, such that the front detachable edges 212A of the foldable shelf panels 21A can be detachably coupled at the front supporting members 11A via the panel supporters 15A. Then, the bottom foldable shelf panel 21A can be pivotally drop down at the front detachable edge 212A thereof from the backing frame, such that the user is able to detachably couple the front detachable edge 212A of the bottom foldable shelf panel 21A with the front supporting members 11A via the panel supporters 15A.

For folding up the storage shelf, the user is able to detach the front detachable edges 212A of all foldable shelf panels 21A from the front supporting members 11A such that the bottom foldable shelf panel 21A, the foldable shelf panel 21A at the lowermost position, can be pivotally lifted up to overlap with the backing frame while the rest of the foldable shelf panels 21A can be pivotally dropped down to overlap with the backing frame. Then, the two side frames 10A can be pivotally moved to overlap with the backing frame as a door closing motion to sandwich the foldable shelf panels 21A between the backing frame and the side frames 10A.

Figure 18:
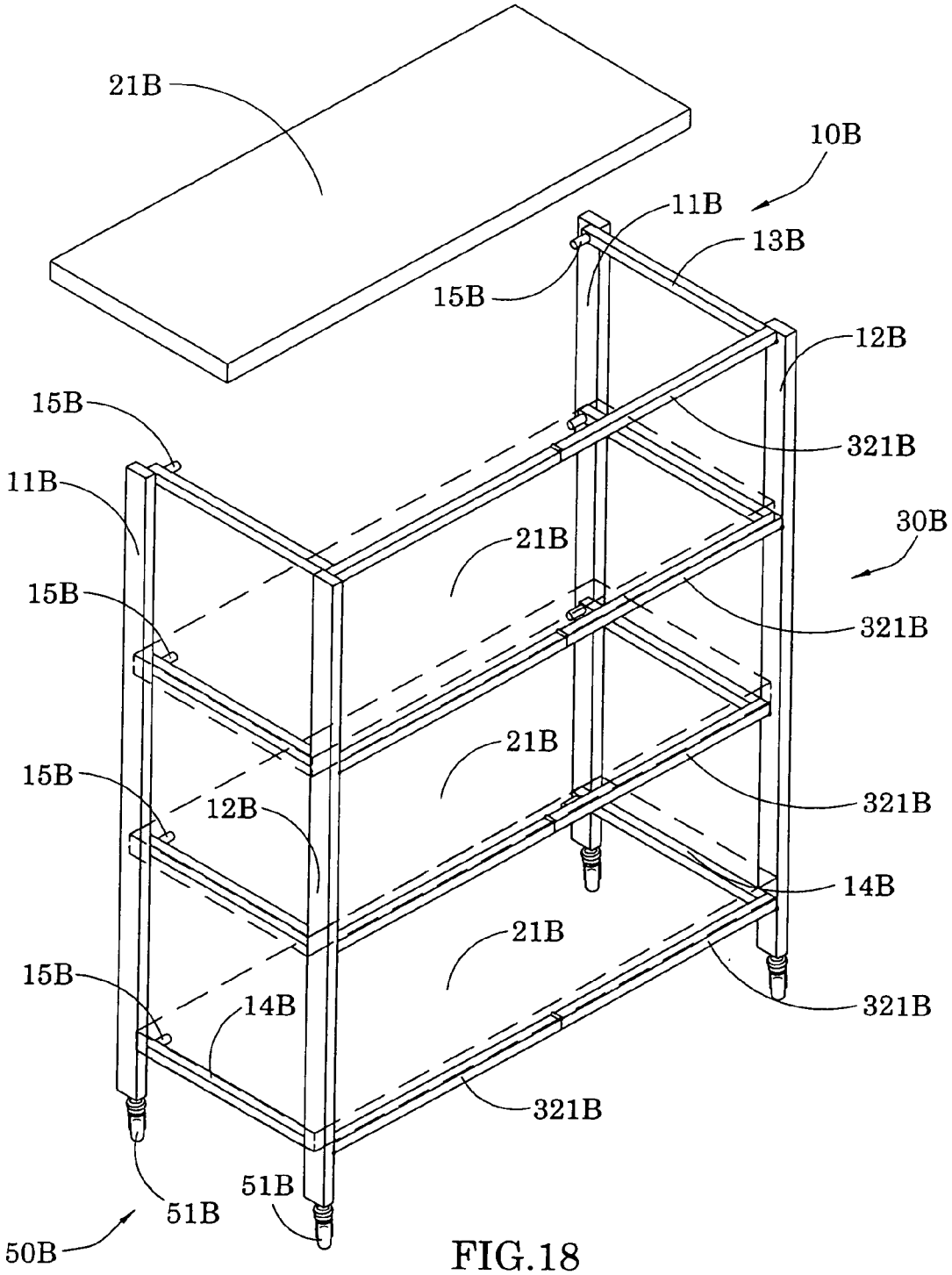
FIG. 18 is a rear perspective view of a foldable and portable storage shelf according to a fourth preferred embodiment of the present invention.

As shown in FIG. 18, a foldable and portable storage shelf of a fourth embodiment illustrates another alternative mode of the first embodiment, wherein the storage shelf comprises two spaced apart side frames 10B, a panel assembly 20B, and a foldable frame 30B.

The foldable frame 30B is operatively coupled with the side frames 10B to fold the panel assembly 20B between an unfolded position and a folded position. At the unfolded position, the panel assembly 20B is rigidly supported between the side frames 10B to form a shelf structure for supporting an object. In addition, at the unfolded position, the foldable portable storage shelf provides three opened sides, i.e. the front side, left side, and right side, for being accessed. At the folded position, the panel assembly 20B is folded to minimize an overall size of the foldable and portable storage shelf.

Accordingly, the two side frames 10B are identical. Each of the side frames 10B comprises two supporting members 11B, 12B, i.e. front supporting member 11B and rear supporting member 12B, spacedly supporting with each other in a vertical manner, such that the four supporting members 11B, 12B form four supporting posts at four corners of the storage shelf respectively. In addition, the front and rear supporting members 11B, 12B form an opened area therebetween.

Each of the side frames 10B further comprises a top supporting member 13B extended between the upper portions of the front and rear supporting members 11B, 12B, and a bottom supporting member 14B extended between the bottom portions of the front and rear supporting members 11B, 12B. Therefore, each of the side frames 10B generally forms a rectangular structure.

The panel assembly 20B comprises a plurality of foldable shelf panels 21B spacedly and detachably supported between the two side frames 11B, wherein at the unfolded position, the foldable shelf panels 21B are parallel with each other and are securely supported between the side frames 10B that each of the foldable shelf panels 21B is extended between the front and rear supporting members 11B, 12B. At the folded position, the foldable shelf panels 21B are detached from the side frames 10B. As shown in FIG. 18, there are four foldable shelf panels 21B being supported between the two side frames 10B.

Figure 19:
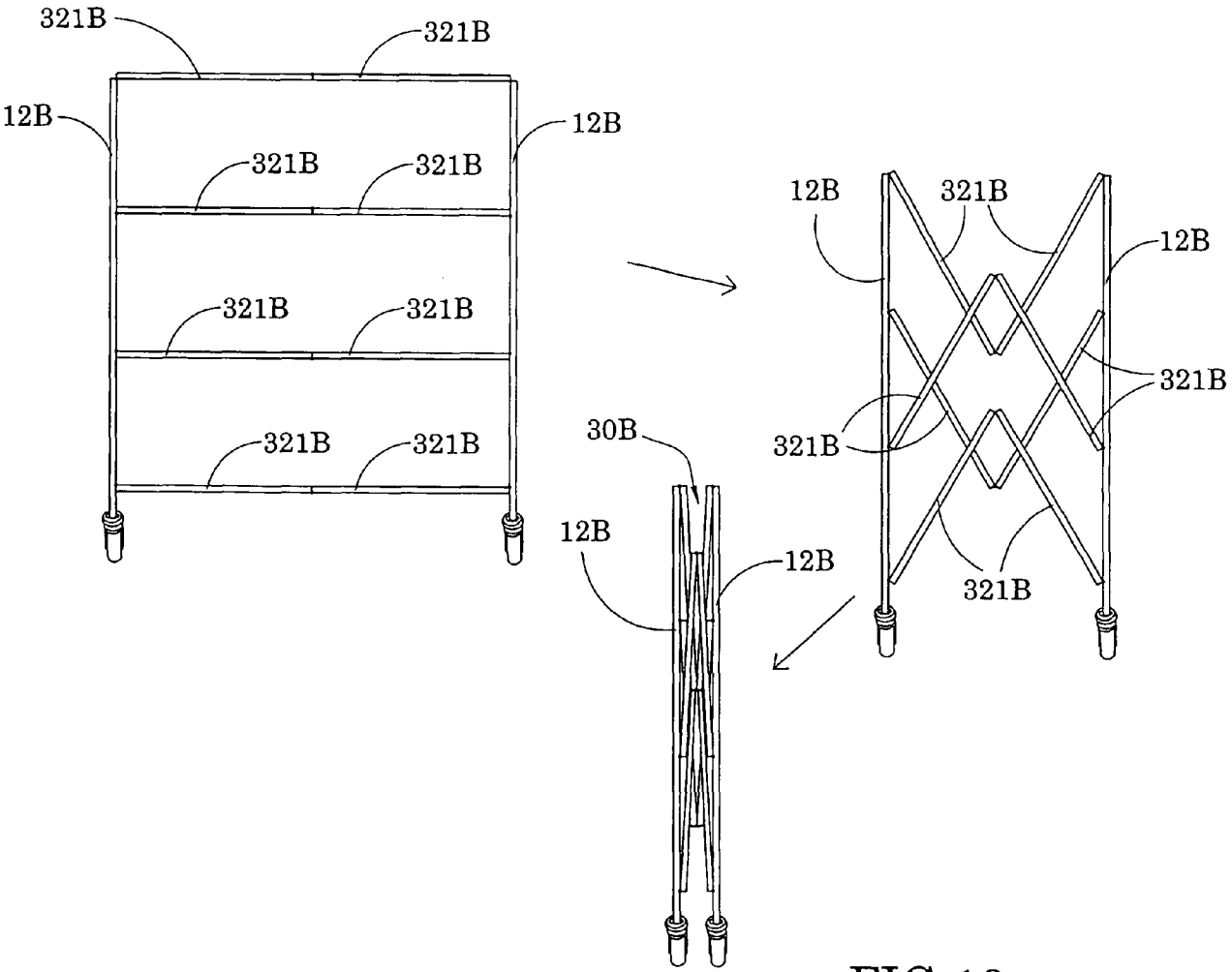
FIG. 19 illustrates a folding operation of the foldable and portable storage shelf according to the above fourth embodiment of the present invention.

The foldable frame 30B is pivotally coupled between the two side frames 10B to fold between the unfolded position and the folded position. At the unfolded position, as shown in FIG. 18, the side frames 10B are pivotally moved apart from each other and are parallel with each other to retain each of the foldable shelf panels 21B between the side frames 10B in a horizontal manner. In other words, at the unfolded position, the side frames 10B are parallelly and spacedly supported that the foldable shelf panels 21B are spacedly and transversely extended between the two side frames 10B such that the object can be placed at the foldable shelf panels 21B. At the folded position, as shown in FIG. 19, the side frames 10B are pivotally moved towards each other such that the side frames 10B are folded side-by-side to minimize a distance between the side frames 10B. In other words, at the folded position, the front and rear supporting members 11B, 12B are moved side-by-side to form the compact structure at the folded position.

The foldable frame 30B comprises a plurality of transmission links 32B pivotally extended between the rear supporting members 12B of the side frames 10B. According to the fourth embodiment, two of the neighboring transmission links 32B form a pair of folding structure. As shown in FIGS. 18 and 19, there are four transmission links 32B pivotally coupled between the rear supporting members 12B, which are corresponding to the number of the foldable shelf panels 21B, such that two pairs of folding structures are provided.

Accordingly, each of the transmission links 32B comprises two pivot arms 321B pivotally coupling with each other end-to-end. In other words, the inner ends of the pivot arms 321B are pivotally connected with each other while the outer ends of the pivot arms 321B are pivotally connected to the rear supporting members 12B. The two pivot arms 321B of each of the transmission links 32B are identical in length. Therefore, when the pivot arms 321B are pivotally folded at the inner ends thereof, the side frames 10B will be moved towards each other to minimize the distance between the side frames 10B at the folded position.

When the foldable frame 30B is folded at the unfolded position, all the transmission links 32B are parallel with each other to maximize the distance between the side frames 10B, i.e. the length of each of the transmission links 32B. When the foldable frame 30B is folded at the folded position, the two transmission links 32B of each pair of folding structure are pivotally moved at opposite directions. In other words, the upper transmission link 32B of each pair of folding structure will pivotally move to form a V-shaped configuration while the lower transmission link 32B of the corresponding pair of folding structure will pivotally move to form an inversed V-shaped configuration.

As shown in FIG. 19, the two pivot arms 321B of the upper transmission link 32B will be pivotally folded at the downward direction. Correspondingly, the two pivot arms 321B of the lower transmission link 32B will be pivotally folded at the upward direction. In other words, the first and third transmission links 32B of the foldable frame 30B are concurrently folded at the downward direction while the second and fourth transmission links 32B of the foldable frame 30B are concurrently folded at the upward direction to fold the side frames 10B side-by-side.

In addition, the upper transmission link 32B of each pair of folding structure is pivotally coupled at the front portions of the rear supporting members 12B while the lower transmission link 32B of the corresponding pair of folding structure is pivotally coupled at the rear portions of the rear supporting members 12B such that when the foldable frame 30B is folded at the folded position, the upper and lower transmission links 32B of each pair of folding structure will not be met each other to block the folding movement of the transmission link 32B.

According to the fourth embodiment, the foldable shelf panels 21B are detachably and spacedly supported between the side frames 10B. The side frame 10B further comprises a plurality of panel supporters 15B for supporting the foldable shelf panels 21B between the side frames 10B in a detachably coupling manner. Accordingly, the panel supporters 15B are spacedly provided at each of the front and rear supporting members 11B, 12B to align with the orientation of the foldable shelf panels 21B at the unfolded position, such that when the foldable shelf panels 21B are supported at the unfolded position, the front and rear edges of the foldable shelf panels 21B are detachably supported by the panel supporters 15B to retain the foldable shelf panels 21B at a horizontal level. It is worth mentioning that the panel supporters 15B are detachably coupled at the bottom sides of the foldable shelf panels 21B such that each of the panel supporters 15B not only forms a support to maintain the respective foldable shelf panel 21B at the unfolded position but also forms a locker to lock up the respective foldable shelf panel 21B at the unfolded position.

The storage shelf of the present invention further comprises a wheel assembly 50B coupling with the side frames 10B, wherein the wheel assembly 50B comprises a plurality of lockable wheels 51B coupling with the bottom ends of the supporting members 11B, 12B respectively. Accordingly, the lockable wheels 51B enhance the mobility of the storage shelf In addition, the lockable wheels 51B further enhance the side frames 10B moving between the folded position and the unfolded position. In other words, when the side frames 10B are moved away from each other to the unfolded position, the lockable wheels 51B will enhance the extending movement between the side frames 10B. Likewise, when the side frames 10B are moved towards each other to the folded position, the lockable wheels 51B will enhance the folding movement between the side frames 10B to minimize the distance between the side frames 10B. It is worth to mention that the lockable wheels 51B can be locked to prevent any unwanted sliding movement of the side frames 10B.

In order to unfold the storage shelf of the present invention from the folded position, the user is able to pull out the side frames 10B from the foldable frame 30B until all the transmission links 32B are parallel with each other and are perpendicular to the side frames 10B. Then, the user is able to place the foldable shelf panels 21B between the side frames 10B, such that the front and rear edges of the foldable shelf panels 21B can be detachably coupled at the front and rear supporting members 11B, 12B via the panel supporters 15B. Accordingly, the width of each of the foldable shelf panels 21B will retain the distance between the side frames 10B to prevent any unwanted lateral movement of the foldable frame 30B between the side frames 10B.

For folding up the storage shelf, the user is able to detach all foldable shelf panels 21B from the front and rear supporting members 11B, 12B such that the side frames 10B are free to move towards each other. Then, by applying an inward force at each of the side frames 10B, the transmission links 32B are correspondingly folded in a pivotal movement to move the side frames 10B side-by-side.

Figure 20:
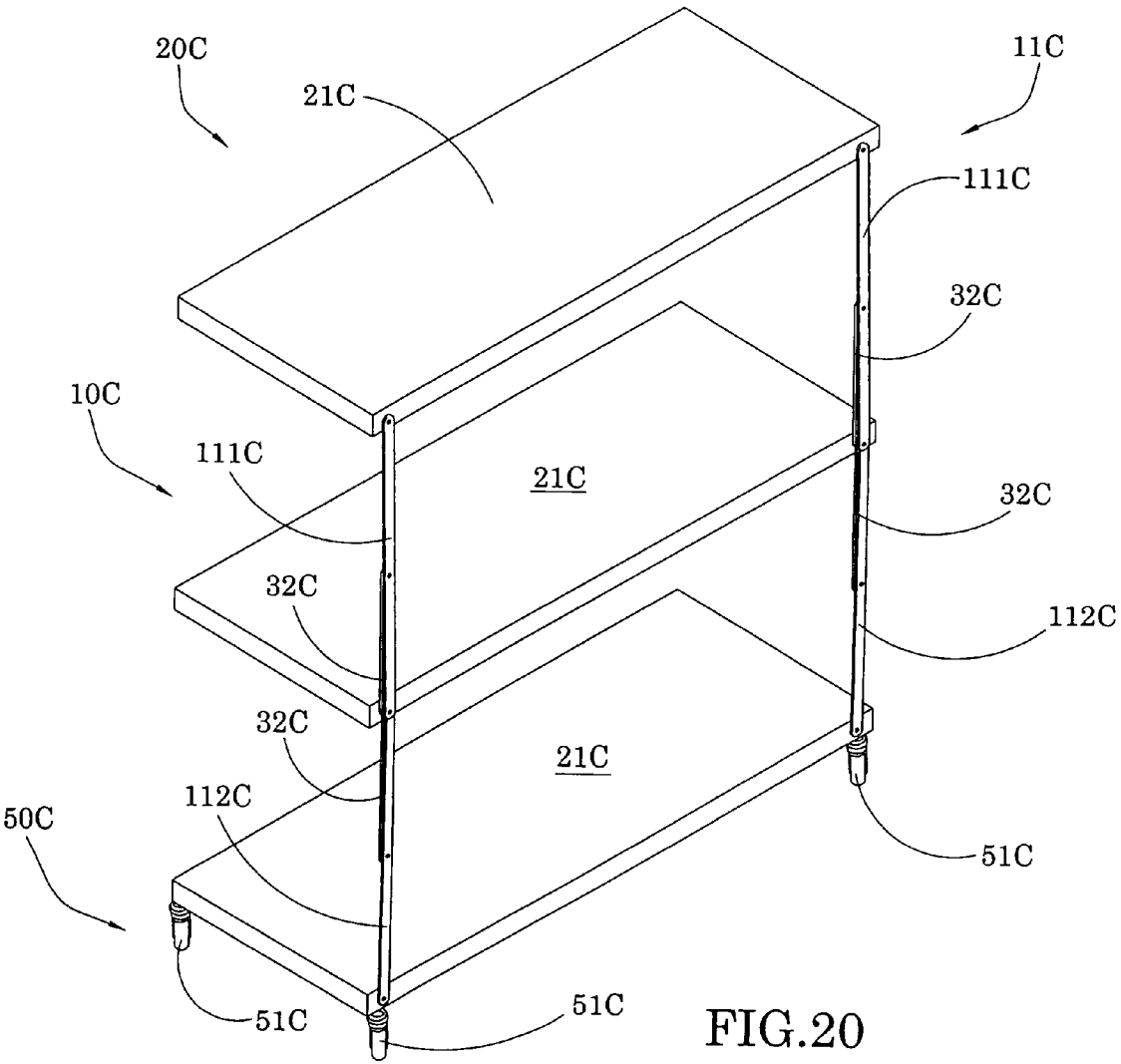
FIG. 20 is a rear perspective view of a foldable and portable storage shelf according to a fifth preferred embodiment of the present invention.

As shown in FIG. 20, a foldable and portable storage shelf of a fifth embodiment illustrates another alternative mode of the first embodiment, wherein the storage shelf comprises two spaced apart side frames 10C, a panel assembly 20C, and a foldable frame 30C.

The foldable frame 30C is operatively coupled with the side frames 10C to fold the panel assembly 20C between an unfolded position and a folded position. At the unfolded position, the panel assembly 20C is rigidly supported between the side frames 10C to form a shelf structure for supporting an object. In addition, at the unfolded position, the foldable portable storage shelf provides three opened sides, i.e. the front side, left side, and right side, for being accessed. At the folded position, the panel assembly 20C is folded to minimize an overall size of the foldable and portable storage shelf.

Accordingly, the two side frames 10C are identical. Each of the side frames 10C comprises two supporting members 11C spacedly supporting with each other in a vertical manner, such that the two supporting members 11C form two supporting posts at the rear corners of the storage shelf respectively.

Each of the supporting members 11C comprises an upper member 111C and a lower member 112C pivotally coupled with each other end-to-end. Accordingly, the upper and lower members 111C, 112C are identical in length. Therefore, when each of the supporting members 11C is folded at the unfolded position, the upper and lower members 111C, 112C are aligned with each other end-to-end. When each of the supporting members 11C is folded at the folded position, the upper and lower members 111C, 112C are pivotally and inwardly moved to form a V-shaped configuration.

The panel assembly 20C comprises a plurality of foldable shelf panels 21C spacedly supported between the two side frames 11C, wherein at the unfolded position, the foldable shelf panels 21C are parallel with each other and are securely and spacedly supported between the side frames 10C that each of the foldable shelf panels 21C is extended between the supporting members 11C. At the folded position, the foldable shelf panels 21C are overlapped with each other to minimize a distance between every two of the folding shelf panels 21C. As shown in FIG. 20, there are three foldable shelf panels 21C, i.e. top, middle, and bottom shelf panels, being supported between the two side frames 10C. In addition, the top end of each of the supporting members 11C is pivotally coupled with the top foldable shelf panel 21C while the bottom end of each of the supporting members 11C is pivotally coupled with the bottom foldable shelf panel 21C. The middle foldable shelf panel 21C is alignedly located at the pivot point of the upper and lower members 111C, 112C of each of the supporting members 11C.

Figure 21:
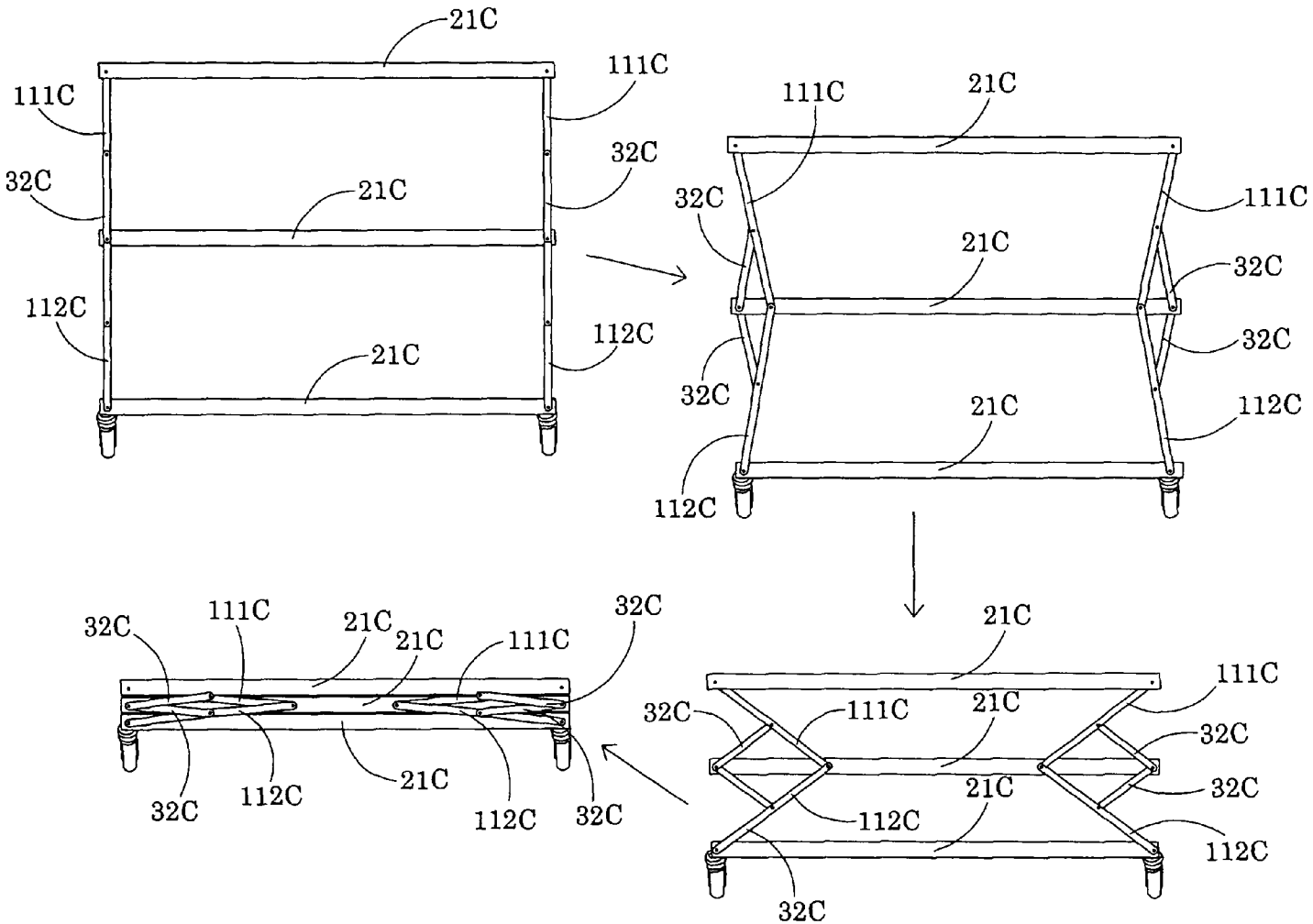
FIG. 21 illustrates a folding operation of the foldable and portable storage shelf according to the above fifth embodiment of the present invention.

The foldable frame 30C is pivotally coupled between the two side frames 10C to fold between the unfolded position and the folded position. At the unfolded position, as shown in FIG. 20, the side frames 10C are pivotally moved apart from each other and are parallel with each other to retain each of the foldable shelf panels 21C between the side frames 10C in a horizontal manner. In other words, at the unfolded position, the side frames 10C are parallelly and spacedly supported that the foldable shelf panels 21C are spacedly and transversely extended between the two side frames 10C such that the object can be placed at the foldable shelf panels 21C. At the folded position, as shown in FIG. 21, the side frames 10C are pivotally moved towards each other such that the side frames 10C are folded to minimize the height of the storage shelf.

The foldable frame 30C comprises a plurality of transmission links 32C pivotally extended at each of the supporting members 11C of the side frame 10C. According to the fifth embodiment, there are two pairs of transmission links 32C, wherein each pairs of transmission links 32C are first and second transmission links 32C. In other words, there are two first transmission links 32C and two second transmission links 32C pivotally coupled with the side frames 10C respectively. Each of the first transmission links 32C has one end pivotally coupled with the middle foldable shelf panel 21C and an opposed end pivotally coupled with a mid-portion of the respective upper member 111C. Each of the second transmission links 32C has one end pivotally coupled with the middle foldable shelf panel 21C and an opposed end pivotally coupled with a mid-portion of the respective lower member 112C.

Accordingly, when the foldable frame 30C is folded at the unfolded position, the first and second transmission links 32C are aligned end-to-end and are alignedly overlapped with the upper and lower members 111C, 112C respectively. When the foldable frame 30C is folded at the folded position, the first and second transmission links 32C are pivotally folded at a V-shaped configuration and are concurrently folded with respect to the upper and lower members 111C, 112C. It is worth mentioning that the folding direction of the first and second transmission links 32C is opposite to the folding direction of the upper and lower members 111C, 112C. In other words, the first and second transmission links 32C are folded outwardly while the upper and lower members 111C, 112C are folded inwardly.

In addition, the pivot point between the first and second transmission links 32C is horizontally aligned with the pivot point between the upper and lower members 111C, 112C. When the foldable frame 30C is folded at the unfolded position, the pivot point between the first and second transmission links 32C is overlappedly aligned with the pivot point between the upper and lower members 111C, 112C. When the foldable frame 30C is folded at the folded position, the pivot point between the first and second transmission links 32C is spacedly aligned with the pivot point between the upper and lower members 111C, 112C. Accordingly, the alignment between the pivot point between the first and second transmission links 32C and the pivot point between the upper and lower members 111C is corresponding to the horizontal level of the middle foldable shelf panel 21C.

The storage shelf of the present invention further comprises a wheel assembly 50C coupling with the panel assembly 20C, wherein the wheel assembly 50C comprises a plurality of lockable wheels 51C coupling with the bottom side of the bottom foldable shelf panel 21C. Accordingly, the lockable wheels 51C enhance the mobility of the storage shelf.

In order to unfold the storage shelf of the present invention from the folded position, the user is able to upwardly pull out the top foldable shelf panel 21C away from the bottom foldable shelf panel 21C until the upper and lower members 111C, 112C of each of the supporting members 11C are aligned with each other end-to-end. During the unfolding operation, the transmission links 32C are pivotally moved in responsive to the pivot movement of the upper and lower members 111C, 111C to retain the middle foldable shelf panel 21C in position.

For folding up the storage shelf, the user is able to pivotally move the upper and lower members 111C, 112C such that the transmission links 32C will be pivotally moved correspondingly. Then, the top foldable shelf panel 21C will be automatically dropped down until the middle foldable shelf panel 21C is overlappedly sandwiched between the top and bottom foldable shelf panels 21C.

Figure 22:
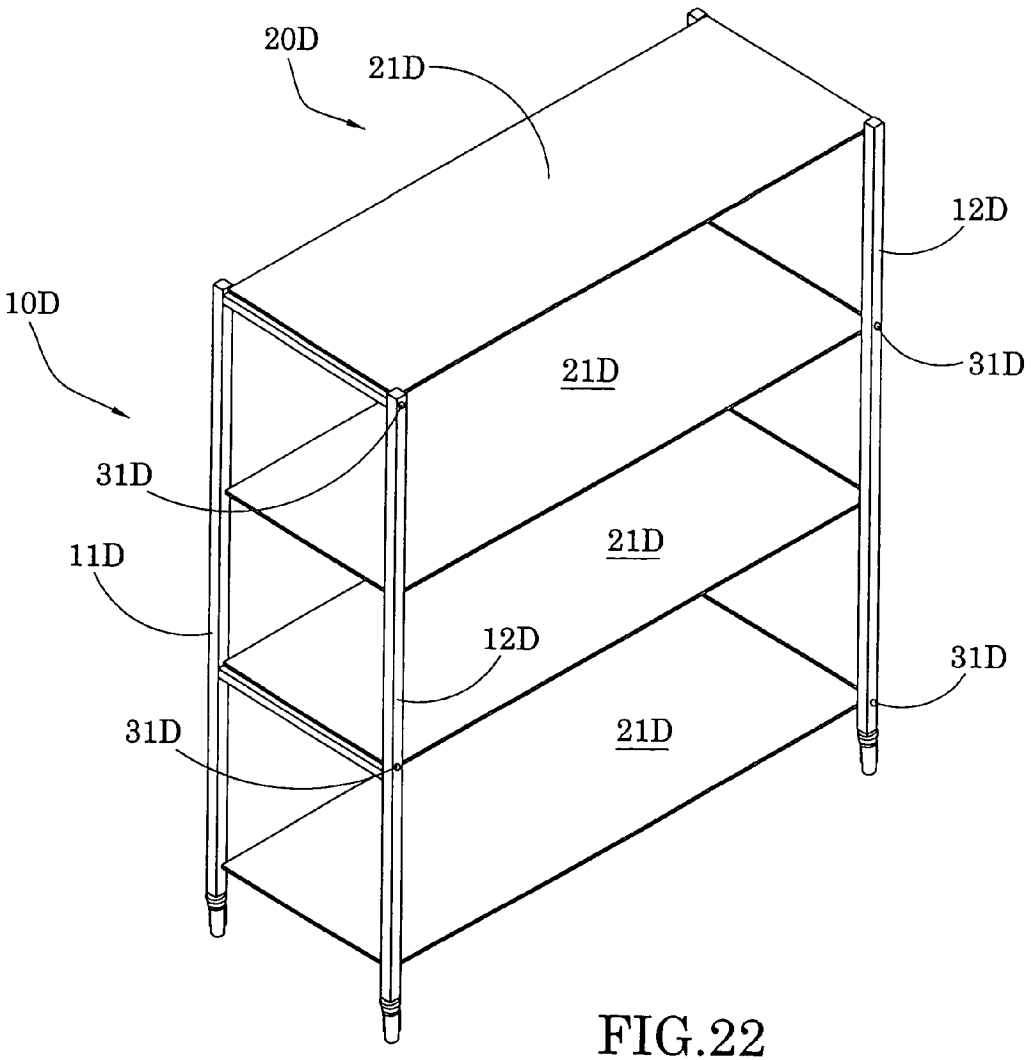
FIG. 22 is a perspective view of a foldable and portable storage shelf according to a sixth preferred embodiment of the present invention.

As shown in FIG. 22, a foldable and portable storage shelf of a sixth embodiment illustrates another alternative mode of the first embodiment, wherein the storage shelf comprises two spaced apart side frames 10D, a panel assembly 20D, and a foldable frame 30D.

The foldable frame 30D is operatively coupled with the side frames 10D to fold the panel assembly 20D between an unfolded position and a folded position. At the unfolded position, the panel assembly 20D is rigidly supported between the side frames 10D to form a shelf structure for supporting an object. In addition, at the unfolded position, the foldable portable storage shelf provides three opened sides, i.e. the front side, left side, and right side, for being accessed. At the folded position, the panel assembly 20D is folded to minimize an overall size of the foldable and portable storage shelf.

Accordingly, the two side frames 10D are identical. Each of the side frames 10D comprises two tubular supporting members 11D, 12D, i.e. front supporting member 11D and rear supporting member 12D, spacedly supporting with each other in a vertical manner, such that the four supporting members 11D, 12D form four supporting posts at four corners of the storage shelf respectively. In addition, the front and rear supporting members 11D, 12D form an opened area therebetween.

The panel assembly 20D comprises a plurality of foldable shelf panels 21D spacedly supported between the two side frames 11D, wherein at the unfolded position, the foldable shelf panels 21D are parallel with each other and are securely supported between the side frames 10D that each of the foldable shelf panels 21D is extended between the front and rear supporting members 11D, 12D. In other words, each of the foldable shelf panels 21D has a side edge supported at one of the side frames 10D and an opposed side edge supported at another side frame 10D. At the folded position, the foldable shelf panels 21D are detached from the side frames 10D. As shown in FIG. 22, there are four foldable shelf panels 21D being supported between the two side frames 10D.

Figure 24:
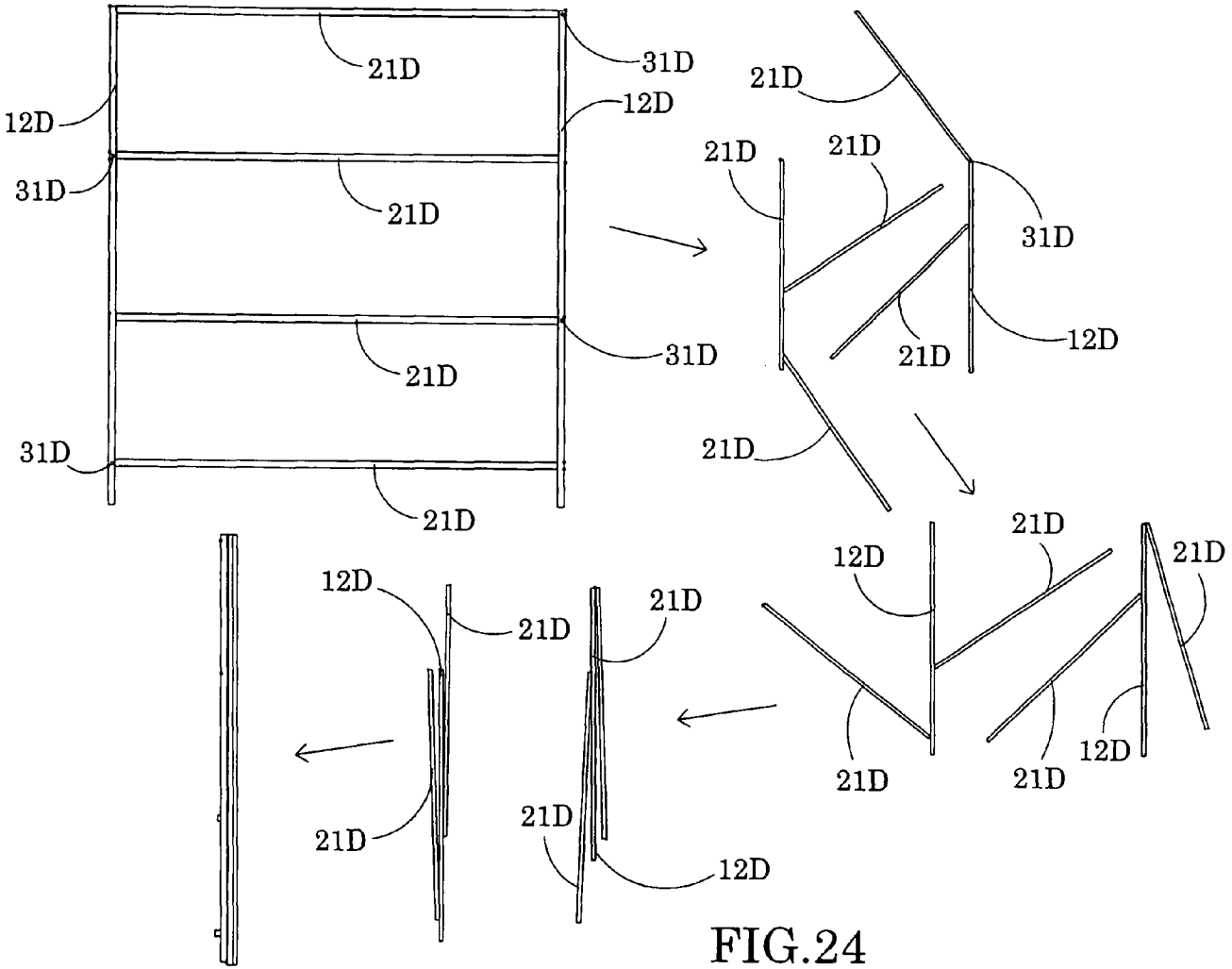
FIG. 24 illustrates a folding operation of the foldable and portable storage shelf according to the above sixth embodiment of the present invention.

The foldable frame 30D is coupled between the two side frames 10D to fold between the unfolded position and the folded position. At the unfolded position, as shown in FIG. 22, the side frames 10D are pivotally moved apart from each other and are parallel with each other to retain each of the foldable shelf panels 21D between the side frames 10D in a horizontal manner. In other words, at the unfolded position, the side frames 10D are parallelly and spacedly supported that the foldable shelf panels 21D are spacedly and transversely extended between the two side frames 10D such that the object can be placed at the foldable shelf panels 21D. At the folded position, as shown in FIG. 24, the side frames 10D are pivotally moved towards each other such that the side frames 10D are folded side-by-side to minimize a distance between the side frames 10D. In other words, at the folded position, the front and rear supporting members 11D, 12D are moved side-by-side to form the compact structure at the folded position.

The foldable frame 30D comprises a plurality of pivot joints 31D provided at the side edges of the foldable shelf panels 21D to form the pivot edges thereof respectively and a plurality of detachable joints 32D provided at the another side edges of the foldable shelf panels 21D to form the detachable edges thereof respectively. In other words, when the detachable edges of the foldable shelf panels 21D are detachably coupled with one of the side frames 10D via the detachable joints 32D, the pivot edges of the foldable shelf panels 21D are adapted to pivotally fold at another side frame 10D via the pivot joints 31D.

Figure 23:
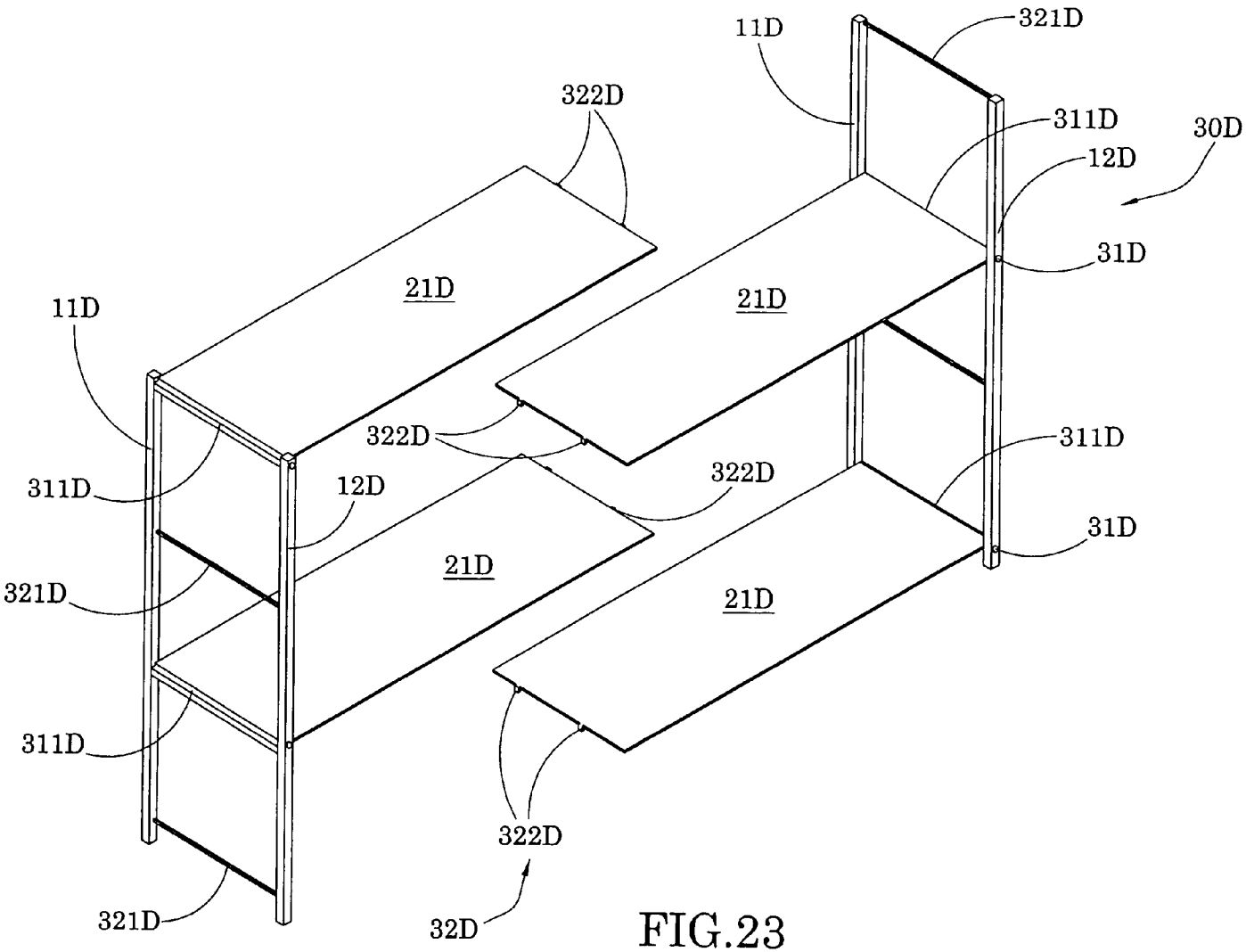
FIG. 23 is an exploded perspective view of the foldable and portable storage shelf according to the above sixth embodiment of the present invention

As shown in FIG. 23, the pivot joints 31D and the detachable joints 32D are alternated provided at the edges of the foldable shelf panels 21D. Therefore, the joint joints 31D are alternated with the detachable joints 32D at each of the side frames 10D. Therefore, the pivot joints 31D and the detachable joints 32D are alternated provided at each of the side frames 10D. In other words, when the pivot edge and the detachable edge of the first foldable shelf panel 21D are coupled between the left and right side frames 10 respectively, the detachable edge and the pivot edge of the second foldable shelf panel 21D are coupled between the left and right side frames 10 respectively. The configurations of the third and fourth foldable shelf panels 21D will be the same as that of the first and second foldable shelf panels 21D respectively.

Accordingly, each of the pivot joints 31D comprises a pivot shaft 311D extended between the front and rear supporting members 11D, 12D of the side frame 10D to pivotally couple with the pivot edge of the corresponding foldable shelf panel 21D.

Each of the detachable joints 32D comprises a supporting shaft 321D extended between the front and rear supporting members 11D, 12D and extended parallel to the pivot shaft 311D, and a detachable member 322D provided at the detachable edge of each of the foldable shelf panels 21D to detachably engage with the supporting shaft 321D. Preferably, each of the detachable members 322D has a hook shape to hang at the supporting shaft 321D.

In order to unfold the storage shelf of the present invention from the folded position, the user is able to pivotally fold each of the foldable shelf panels 21D until the detachable edge thereof is aligned to another side frame 10D. Therefore, by engaging all the detachable member 322D with the supporting shafts 321D respectively, the foldable shelf panels 21D are retained parallel to each other and are rigidly supported between the two side frames 10D.

For folding up the storage shelf, the user is able to detach the detachable edges of the foldable shelf panels 21D from the side frames 10D by disengaging the detachable members 322D with the supporting shaft 321D. Therefore, the storage shelf will be disassembled into two identical folding structures. Then, the foldable shelf panel 21D at the upper position can be pivotally and downwardly folded towards the respective side frame 10D while the foldable shelf panel 21D at the lower position can be pivotally and upwardly flipped towards the respectively side frame 10D. In other words, the side frame 10D will be sandwiched between two corresponding foldable shelf panel 21D. Therefore, the two folding structures can be placed side-by-side to minimize the distance between the two side frames 10D.

One skilled in the art will understand that the embodiment of the present invention as shown in the drawings and described above is exemplary only and not intended to be limiting.

It will thus be seen that the objects of the present invention have been fully and effectively accomplished. The embodiments have been shown and described for the purposes of illustrating the functional and structural principles of the present invention and is subject to change without departure from such principles. Therefore, this invention includes all modifications encompassed within the spirit and scope of the following claims.

What is claimed is:

1. A frame structure, comprising:

two spaced apart side frames;

a foldable frame, which is operatively provided only at a rear of said side frames to fold between an unfolded position and a folded position, comprising:

a transmission link, which is an elongated member, rigidly supported between said side frames;

a sliding joint slidably coupling with said transmission link; and two folding arms movably coupling said transmission link to said side frames respectively, wherein each of said folding arms has an upper end pivotally coupling with said sliding joint and a lower end pivotally coupling with said respective side frame, wherein when said foldable frame is folded at said unfolded position, said sliding joint is upwardly slid to an upper end of said transmission link so as to move said side frames away from each other, and when said foldable frame is folded at said folded position, said sliding joint is downwardly slid away from said upper end of said transmission link so as to move said side frames towards each other for folding said side frames side-by-side;

a retention stopper provided at said upper end of said transmission link to bias against said sliding joint when said sliding joint is slid at said upper end of said transmission link at said unfolded position so as to prevent any further upward sliding movement of said sliding joint; and a locking means for releasably locking said foldable frame at said unfolded position, wherein said locking means comprises a first locker provided at said retention stopper provided at said upper end of said transmission link and a second locker provided at said sliding joint to releasably engage with said first locker, so as to lock up sliding joint at said upper end of said transmission link when said foldable frame is folded at said unfolded position;

wherein said transmission link, said sliding joint, and said folding arms of said foldable frame are embedded between said side frames in a hidden manner when said foldable frame is folded at said folded position.

2. The frame structure, as recited in claim 1, wherein each of said folding arms is extended in an inclined manner from said sliding joint to said respective side frame for providing a rigid support of foldable frame at said unfolded position, wherein said transmission link and said folding arms forms a rigid support for distributing force to said side frames through said folding arms.

3. The frame structure, as recited in claim 1, wherein said sliding joint has a sliding through slot for said transmission link slidably passing therethrough and two side wings extended sidewardly to pivotally couple with said upper ends of said folding arms respectively.

4. The frame structure, as recited in claim 2, wherein said sliding joint has a sliding through slot for said transmission link slidably passing therethrough and two side wings extended sidewardly to pivotally couple with said upper ends of said folding arms respectively.

5. The frame structure, as recited in claim 2, wherein each of said side frames comprises two supporting members being spaced from each other and disposed in a vertical manner that said foldable frame is coupled between said supporting members of said side frames, wherein one of said supporting members in said side frame has a U-shaped cross sectional portion to define a receiving cavity, wherein when said foldable frame is folded side-by-side at said folded position, said transmission link, said sliding joint, and said folding arms of said foldable frame are enclosed within said receiving cavities of said respective supporting members in a hidden manner.

6. The frame structure, as recited in claim 3, wherein each of said side frames comprises two supporting members being spaced from each other and disposed in a vertical manner that said foldable frame is coupled between said supporting members of said side frames, wherein one of said supporting members in said side frame has a U-shaped cross sectional portion to define a receiving cavity, wherein when said foldable frame is folded side-by-side at said folded position, said transmission link, said sliding ioint, and said folding arms of said foldable frame are enclosed within said receiving cavities of said respective supporting members in a hidden manner.

7. The frame structure, as recited in claim 4, wherein each of said side frames comprises two supporting members being spaced from each other and disposed in a vertical manner that said foldable frame is coupled between said supporting members of said side frames, wherein one of said supporting members in said side frame has a U-shaped cross sectional portion to define a receiving cavity, wherein when said foldable frame is folded side-by-side at said folded position, said transmission link, said sliding ioint, and said folding arms of said foldable frame are enclosed within said receiving cavities of said respective supporting members in a hidden manner.

8. The frame structure, as recited in claim 2, wherein said transmission link is an elongated member vertically supported between said two side frames and is arranged in such a manner that when said transmission link is moved upwardly at a vertical direction, said sliding joint is correspondingly slid along said transmission link away from said upper end thereof such that said side frames are moved toward each other to hide said transmission link between said side frames, and when said transmission link is moved downwardly at the vertical direction, said sliding joint is correspondingly slid along said transmission link to said upper end thereof such that said frames are moved away from each other until said foldable frame is moved at said unfolded position.

9. The frame structure, as recited in claim 4, wherein said transmission link is an elongated member vertically supported between said two side frames and is arranged in such a manner that when said transmission link is moved upwardly at a vertical direction, said sliding joint is correspondingly slid along said transmission link away from said upper end thereof such that said side frames are moved toward each other to hide said transmission link between said side frames, and when said transmission link is moved downwardly at the vertical direction, said sliding joint is correspondingly slid along said transmission link to said upper end thereof such that said frames are moved away from each other until said foldable frame is moved at said unfolded position.

10. The frame structure, as recited in claim 7, wherein said transmission link is an elongated member vertically supported between said two side frames and is arranged in such a manner that when said transmission link is moved upwardly at a vertical direction, said sliding joint is correspondingly slid along said transmission link away from said upper end thereof such that said side frames are moved toward each other to hide said transmission link between said side frames, and when said transmission link is moved downwardly at the vertical direction, said sliding joint is correspondingly slid along said transmission link to said upper end thereof such that said frames are moved away from each other until said foldable frame is moved at said unfolded position.

11. The frame structure, as recited in claim 4, further comprising a panel assembly which comprises a plurality of foldable panels spacedly supported between said side frames, wherein each of said foldable panels comprises two side panels pivotally coupled with each other at a position that two outer edges of said side panels are pivotally coupled with said side frames respectively while two inner edges of said side panels are pivotally coupled with each other to define a pivot point between said two inner edges of said side panels, wherein a bottom end of said transmission link is pivotally coupled at said pivot point of said foldable panel at the lowermost position while an upper end of said transmission link is coupled at said pivot point of said foldable panel at the uppermost position, such that when said foldable frame is folded at said unfolded position, said inner edges of said side panels are downwardly folded to align said side panels with each other to form a planar configuration, and when said foldable frame is folded at said folded position, said inner edges of said side panels are upwardly folded to overlap said side panels with each other.

12. The frame structure, as recited in claim 7, further comprising a panel assembly which comprises a plurality of foldable panels spacedly supported between said side frames, wherein each of said foldable panels comprises two side panels pivotally coupled with each other at a position that two outer edges of said side panels are pivotally coupled with said side frames respectively while two inner edges of said side panels are pivotally coupled with each other to define a pivot point between said two inner edges of said side panels, wherein a bottom end of said transmission link is pivotally coupled at said pivot point of said foldable bottom panel at the lowermost position while an upper end of said transmission link is coupled at said pivot point of said foldable panel at the uppermost position, such that when said foldable frame is folded at said unfolded position, said inner edges of said side panels are downwardly folded to align said side panels with each other to form a planar configuration, and when said foldable frame is folded at said folded position, said inner edges of said side panels are upwardly folded to overlap said side panels with each other.

13. The frame structure, as recited in claim 10, further comprising a panel assembly which comprises a plurality of foldable panels spacedly supported between said side frames, wherein each of said foldable panels comprises two side panels pivotally coupled with each other at a position that two outer edges of said side panels are pivotally coupled with said side frames respectively while two inner edges of said side panels are pivotally coupled with each other to define a pivot point between said two inner edges of said side panels, wherein a bottom end of said transmission link is pivotally coupled at said pivot point of said foldable panel at the lowermost position while an upper end of said transmission link is coupled at said pivot point of said foldable panel at the uppermost position, such that when said foldable frame is folded at said unfolded position, said inner edges of said side panels are downwardly folded to align said side panels with each other to form a planar configuration, and when said foldable frame is folded at said folded position, said inner edges of said side panels are upwardly folded to overlap said side panels with each other.

14. The frame structure, as recited in claim 7, further comprising a frame locker for releasably locking said side frames at said folded position, wherein said frame locker comprises a first locking element provided at one of said side frames and a pivot locker pivotally coupled at another said side frame to releasably engage with said first locking element when said side frames are moved side-by-side at said folded position to hide said transmission link therebetween.

15. The frame structure, as recited in claim 10, further comprising a frame locker for releasably locking said side frames at said folded position, wherein said frame locker comprises a first locking element provided at one of said side frames and a pivot locker pivotally coupled at another said side frame to releasably engage with said first locking element when said side frames are moved side-by-side at said folded position to hide said transmission link therebetween.

16. The frame structure, as recited in claim 13, further comprising a frame locker for releasably locking said side frames at said folded position, wherein said frame locker comprises a first locking element provided at one of said side frames and a pivot locker pivotally coupled at another said side frame to releasably engage with said first locking element when said side frames are moved side-by-side at said folded position to hide said transmission link therebetween.

* * * * *